US007770366B2

(12) United States Patent
Macleod et al.

(10) Patent No.: US 7,770,366 B2
(45) Date of Patent: Aug. 10, 2010

(54) SYSTEMS FOR AUTOMATICALLY SEALING A PLASTIC BAG/ENCLOSURE OVER CONTAINERS OF PERISHABLES CARRIED ON A PALLET

(75) Inventors: Richard F. J. Macleod, Salinas, CA (US); Frederick Forgnone, Salinas, CA (US); Jason Wells, Gillroy, CA (US)

(73) Assignee: Transfresh Corporation, Salinas, CA (US)

( * ) Notice: Subject to any disclaimer, the term of this patent is extended or adjusted under 35 U.S.C. 154(b) by 23 days.

(21) Appl. No.: 12/075,537

(22) Filed: Mar. 11, 2008

(65) Prior Publication Data

US 2008/0216450 A1 Sep. 11, 2008

Related U.S. Application Data

(63) Continuation-in-part of application No. 11/390,947, filed on Mar. 27, 2006, now abandoned.

(51) Int. Cl.
*B65B 31/08* (2006.01)

(52) U.S. Cl. ..... 53/502; 53/511; 53/171; 53/556; 53/567

(58) Field of Classification Search ..... 53/171, 53/502, 510–512, 556, 567, 570, 576; *B65B 31/04, B65B 31/08*

See application file for complete search history.

(56) References Cited

U.S. PATENT DOCUMENTS 3,640,048 A * 2/1972 Zelnick et al. ..... 53/442
3,997,054 A * 12/1976 Berghgracht ..... 206/598
4,055,931 A * 11/1977 Myers ..... 53/510
4,821,489 A * 4/1989 MacLeod et al. ..... 53/570
5,014,495 A * 5/1991 Bolejack et al. ..... 53/433
5,042,235 A * 8/1991 Hannen et al. ..... 53/557
5,046,302 A * 9/1991 Bolejack et al. ..... 53/459
5,111,639 A * 5/1992 Bolejack et al. ..... 53/408
5,314,286 A * 5/1994 Bolejack et al. ..... 414/416.05
5,945,147 A * 8/1999 Borchard ..... 426/393
6,305,148 B1 * 10/2001 Bowden et al. ..... 53/510
6,532,717 B1 * 3/2003 Forgnone et al. ..... 53/399
7,644,560 B2 * 1/2010 Bowden et al. ..... 53/432
2002/0170270 A1 * 11/2002 Borchard ..... 53/510
2003/0182900 A1 * 10/2003 Bowden et al. ..... 53/510
2005/0183397 A1 * 8/2005 Forgnone et al. ..... 53/511
2007/0220830 A1 * 9/2007 Macleod ..... 53/441

FOREIGN PATENT DOCUMENTS

EP 156012 A1 * 10/1985
FR 2552731 A1 * 4/1985
WO WO 9405550 A1 * 3/1994
WO WO 9916671 A1 * 4/1999

* cited by examiner

*Primary Examiner*—Stephen F Gerrity
(74) *Attorney, Agent, or Firm*—Patrick F. Bright

(57) ABSTRACT

Methods and apparatus for enclosing a palletized container of fresh containers of perishables inside a modified atmosphere-containing plastic bag/enclosure stretched over the containers and over upwardly-folded and sealed margins of a plastic sheet placed between the pallet and the containers to seal the containers of perishables inside the bag/enclosure and to facilitate forming and maintaining a modified atmosphere inside the bag/enclosure.

6 Claims, 29 Drawing Sheets

SYSTEMS FOR AUTOMATICALLY SEALING A PLASTIC BAG/ENCLOSURE OVER CONTAINERS OF PERISHABLES CARRIED ON A PALLET

This application is a continuation-in-part of U.S. patent application Ser. No. 11/390,947, filed with the U.S. Patent and Trademark Office on Mar. 27, 2006, and now abandoned. The fresh perishables trade uses modified atmosphere technologies on bagged, or otherwise enclosed, and sealed, pallet unit quantities of perishables to preserve freshness and reduce market losses during distribution. Current systems that a pallet bag be placed over a unitized pallet of perishables, which are placed in containers. The pallet bag is then sealed to a plastic sheet positioned on top of the pallet under the unitized containers of perishables. Once the pallet bag is sealed, desired quantities of one or more gasses are injected into the pallet bag, creating a modified atmosphere, which benefits the enclosed perishables. Bolejack, et al. U.S. Pat. Nos. 5,014,495; 5,046,302; 5,111,639; and 5,314,286, Forgnone, et al. U.S. Pat. No. 6,532,717; and MacLeod, et al. U.S. Pat. No. 4,821,489 describe such methods and apparatus.

BACKGROUND OF THE INVENTION

There is a need to improve the automation and consistency of the current systems. Current systems require up to three persons to operate effectively. These systems produce completed pallets at a rate of up to about one per minute. The new methods and apparatus, with preferred embodiments, provide automated systems capable of reliably producing a finished pallet every 30 seconds, with fewer persons needed to operate the system.

Current systems require manual manipulation of the bags and the plastic sheets, and staples to hold plastic materials in place. The new systems eliminate the need for manual manipulation, and the need for staples.

SUMMARY OF THE INVENTION

A pallet bearing a plurality of containers of fresh perishables is placed on a conveyor. The perishables load, and a plastic sheet is automatically inserted on the pallet in the gap created above the pallet and below the suspended load. The margins of this bottom sheet extend beyond the edges of the pallet on all sides. See Bolejack, et al. U.S. Pat. Nos. 5,014,495; 5,111,639, and 5,314,286; and Forgnone, et al., U.S. patent application Ser. No. 10/785,868, filed in the United States Patent and Trademark Office Feb. 24, 2004, entitled "Apparatus and Methods For Enclosing Product Units," now abandoned, for disclosures of such apparatus and methods.

After the sheet is in place, and the containers of perishables are placed atop the pallet and sheet, the resulting pallet unit is conveyed to a bagging station. There, a plastic bag is automatically applied from above the palletized unit. The bag is stretched over, and then down the exterior surfaces of the stacked unit. Once the stretched film is released, the film, which forms a bag, is effectively pulled tightly against the exterior surfaces. Tension of the stretched bag against the pallet unit surfaces is also sufficient to brace/stabilize the palletized unit.

The new system may automatically position and fold the overhanging margins of the bottom sheet upwards, against the sides of the perishables containers atop the pallet. The system then holds the sheet margins in a vertical position long enough for the descending bag to overlap and capture the sheet margins, and to hold the margins in the vertical, upward position against the perishables containers, inside the margins of the stretched bag. The bag opening is preferably positioned above the plane of the pallet surface, leaving a portion (e.g., two inches) of the vertically positioned bottom sheet exposed. The bag overlaps the remaining portions of the bottom sheet. Because the bag has been stretched, the elasticity of the bag pulls tight against, and holds the sheet margins in place. Once held by the stretched bag, the system holding the sheet margins upwards is withdrawn or cycled off. Alternatively, the sheet margins may overlie the margins at the opening of the bag.

Some perishables items require only one gas to create an appropriate modified atmosphere. For strawberries, this gas may be carbon dioxide. Typically, after bagging and sealing, any gases may be injected. Alternatively, gases may be delivered over the perishables inside the bag as the bag is stretched over the perishables containers prior to sealing. A shrink hood stretching mechanism stretches the bag out and down adjacent to each corner of the unitized perishables. Gas delivery nozzles for creating a modified atmosphere environment inside the bag may be positioned under each corner of the bag stretching device. When activated, these nozzles deliver appropriate quantities of one or more gasses inside the bag to form a desired modified atmosphere as the bag is pulled and stretched over the unitized loads.

After leaving the bagging station, an in line tape or stretch wrap seal may be applied to the bag margins which overlap the vertically-positioned bottom sheet margins. The bag margins preferably lie substantially flat against the margins of the sheet and the container surfaces, providing a substantially smooth surface for tape or stretch film to be applied. Once properly applied, a seal is formed and substantially no gases may escape from the interior of the bag. These flat surfaces may also facilitate heat sealing of the bag to the sheet margins. See, e.g., Bolejack, et al. U.S. Pat. Nos. 5,014,495; 5,046,302; 5,111,639; and 5,314,286; Forgnone, et al. U.S. Pat. No. 6,532,717; and MacLeod, et al. U.S. Pat. No. 4,821,489, describing such methods and apparatus.

The permeability of the bag is preferably tailored to a specific perishable item. To form and maintain a desired modified atmosphere inside the sealed bag, the type and weight of the perishables must be determined. By weighing each pallet, the respiration load of the perishable inside the enclosed bag can be determined. Based on this data, a system for punching or cutting calibrated holes in the pallet bag, forms one or more appropriate openings in the bag, and/or an appropriate hole such that a breathing membrane or label may be placed over such a hole. The size of hole and type of label varies with the type/variety and weight of the perishables item, and with the gas permeability of the bag. The breathing labels and/or calibrated holes help to maintain a desired controlled or modified atmosphere inside a bag, by balancing the desired components, e.g., carbon dioxide and oxygen, with the film permeability and perishable respiration load.

In another embodiment, the system may automatically convey a pallet bearing a plurality of containers of fresh perishables to a squeeze station where the unitized load is squeezed and separated from the pallet, and a plastic sheet is automatically inserted on the pallet in the gap created above the pallet and below the suspended load. The margins of this bottom sheet extend beyond the edges of the pallet on all sides. After the sheet is in place, and the containers of perishables are positioned atop the pallet and sheet, the resulting pallet unit is conveyed to a folding station.

At the folding station, a folder system senses the presence of a load bearing pallet, and activates a corner fold-forming system that folds the margins of the pallet sheet upwardly against the load at all four corners of the pallet. The system then heat seals each corner fold, simultaneously or seriatim.

The system then conveys the palletized load to the bagging unit, where a bag is automatically applied. The descending bag overlaps and captures the sheet margins inside the margins of the stretched bag. The bag opening is preferably positioned above the plane of the pallet surface, leaving a portion (e.g., two inches) of the vertically positioned bottom sheet exposed. The bag overlaps the remaining portions of the bottom sheet. Because the bag has been stretched, the elasticity of the bag pulls tight against, and holds the sheet margins in place. Alternatively, the system may be configured to stretch and place the bag over the palletized load, and the margins of the bottom sheet may then be folded or otherwise placed upwardly outside the margins of the bag/enclosure.

The system then automatically conveys the palletized, bagged load to a modified atmosphere delivery station. There, the bag is automatically perforated with a gas injector, and one or more gasses are injected into the bag. The nature and quantity of these gasses is based upon the height and weight of the palletized perishables, which the system measures, and upon the nature of the perishables, and may be computed, by a computer or otherwise, preferably from a look-up table that uses the weight, height and nature of perishable data to determine the nature and quantity of gases to inject.

The system then conveys the bagged, gasified, palletized load to a taping station, where the system automatically applies tape to the periphery of the palletized load at the junction of the bag's opening and the margins of the pallet sheet. The tape may be delivered from a tape roll by a pressure roller that follows and presses the tape against the palletized load. The tape may then be automatically cut from the tape roll when the taping of the palletized load is completed.

The system conveys the palletized, bagged, gasified, taped, or otherwise sealed load to an offload station for delivery elsewhere.

BRIEF DESCRIPTION OF THE DRAWINGS

The various features and advantages of this invention will become apparent in light of the following detailed description, taken together with the accompanying drawings, in which.

DETAILED DESCRIPTION OF THE PREFERRED EMBODIMENTS

Figure 1:
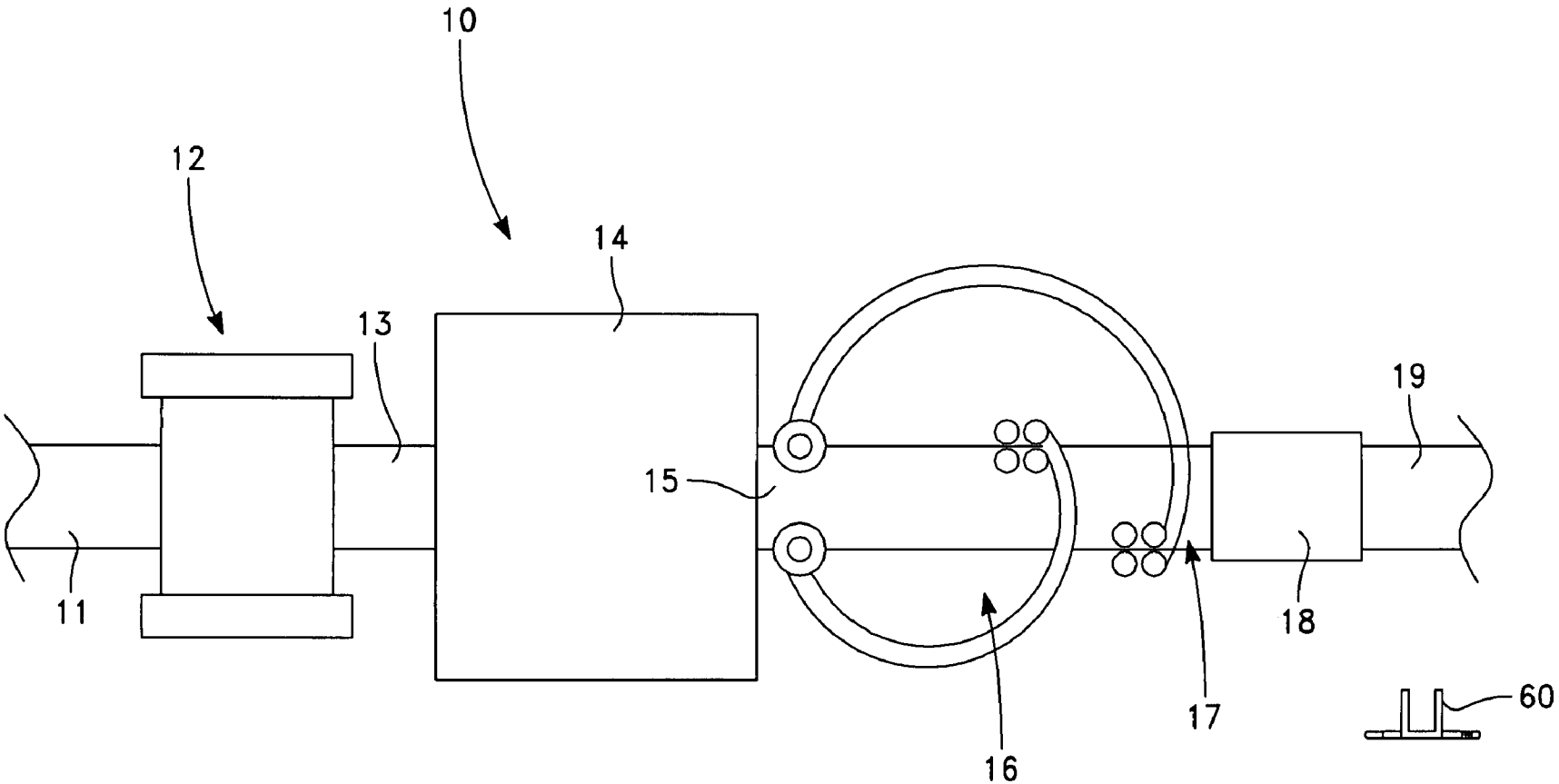
FIG. 1 shows a schematic plan view of a preferred embodiment of a layout of the bagging system of this invention.

FIG. 1 is a schematic, plan view of palletized container of perishables bagging apparatus 10. In apparatus 10, conveyor 11 moves a plurality of pallets, each loaded with a plurality of containers of perishables, e.g., strawberry containers, stacked on the upper surface of the pallet. As an example, a pallet may carry 16 tiers, with six trays in each tier, and have an overall height of about 90 inches. Each tray may contain a plurality of strawberry baskets. The pallet itself may have a circumference in the range of 150 to 200 inches, and be rectangular or square in shape. Where the perishable is strawberries, the strawberries are preferably cooled to a temperature of about 33 degrees F. The perishables are preferably cooled to, and maintained at an optimum storage temperature, before the bagging operation begins.

A plurality of pallets, each loaded with perishables, may be brought to in-feed 11, e.g., by forklift. In-feed 11 conveys the pallets, one at a time, to squeeze station 12. At squeeze station 12, hydraulically actuated, one or two pairs of opposed vertical walls are activated to engage and squeeze the pallet load of containers of perishables above the pallet with sufficient force to permit the floor plate beneath the pallet to be lowered from the load supporting position, or to raise the pallet load from the pallet. See, e.g. Bolejack, et al. U.S. Pat. Nos. 5,014,495, 5,046,302; 5,111,639, and 5,314,286; Forgnone, et al. U.S. Pat. No. 6,532,717; and MacLeod, et al. U.S. Pat. No.

4,821,489, describing such methods and apparatus. After the pallet and load have been separated from one another, a plastic sheet is automatically placed on the pallet in the gap formed between the unitized load and the pallet. The inserted sheet then rests on the pallet's upper surface. This sheet is generally flat, and the margins of the sheet extend beyond the edges of the pallet. After placement of the sheet on the pallet, the pallet may then be raised, or the pallet load may be lowered, to replace the perishables containers onto the plastic sheet atop the pallet. The pallet, with its plastic sheet and perishables atop the plastic sheet, is then conveyed on path 13 into bagging station 14.

At bagging station 14, a plastic bag of appropriate size, shape, type and gas permeability is automatically applied. The bag is formed from tube stock which descends from a supply above the pallet of perishables, and is formed into a bag. The bag is stretched to fit over the perishables and unitized containers of perishables. Simultaneously, the system automatically positions the overhanging margins of the deck sheet upwards to a vertical position against the sides of the perishables containers. The system holds these margins in this position for a time sufficient for the descending bag to overlap and capture these margins in the vertical upward position against the sides of the containers, and now inside the stretched pallet bag. The margins at the opening of the bag are positioned above the pallet, leaving a portion of the vertically-extended sheet margins exposed. Because the bag has been stretched, and released against the load, the elasticity of the bag pulls tight against, and holds the vertically positioned margins of the sheet in place. Thereafter, the system holding the sheet margins vertically upwards is withdrawn or cycled off Bagging apparatus of this type use, for example, automatic systems from Lachenmeier, Beumer, and Moeller stretch hood systems.

In preferred embodiments, as a bag descends over the perishables on the pallet, one or more gasses appropriate for creating a desired modified atmosphere inside the bag, and over the perishables, may be injected under the bag to blanket or cover the perishables as the bag is stretched over the perishables load. For this purpose, nozzles may be positioned under one or more corners of the bag so the bag descends over the perishables so that the gas is delivered at up to four locations, to form a desired modified atmosphere inside the bag.

The bagged palletized perishables leave bagging station 14 and passes on path 15 to sealing station 16. There, a taping mechanism applies tape or other suitable material where the bag overlaps the decking sheet, preferably around the entire circumference of the bagged palletized containers of perishables creating a substantially air-tight seal. The sealed palletized bagged perishables unit then passes on path 15 to weighing scale 18, for weighing. Using the weight of this unit, and the nature and temperature of the perishables, the respiration load for the perishable can be determined. From scale 18, the unit passes on path 17 to station 19 where, based in part on the measured weight, or respiration load, calibrated holes are formed in the bag as appropriate to maintain the desired modified atmosphere within the bag. Labels, membranes or other such devices may also, or alternatively, be applied to the bag to modify the permeability of the bag, and maintain a desired modified atmosphere within the bag for the respiration load as determined.

Figure 2:
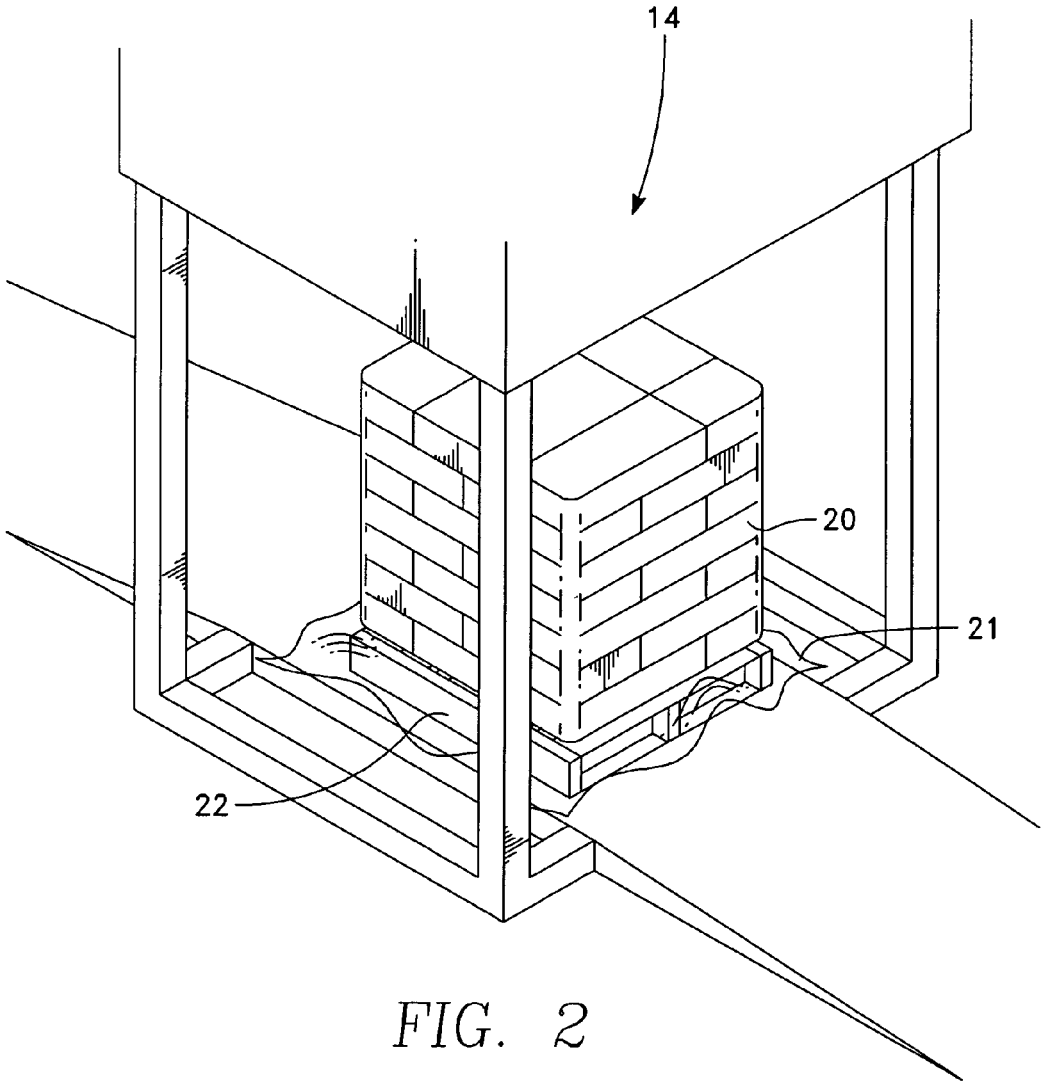
FIG. 2 shows a perspective view of a system for applying a bag to a pallet of containers of perishables, and for forming a modified gas atmosphere inside the bag.

FIG. 2 shows pallet 22 bearing a load of perishables 20 with plastic sheet 21 between the pallet's upper surface and the bottom surface of the perishables. Sheet 21 extends over the margins of pallet 22 on all four sides.

Figure 3:
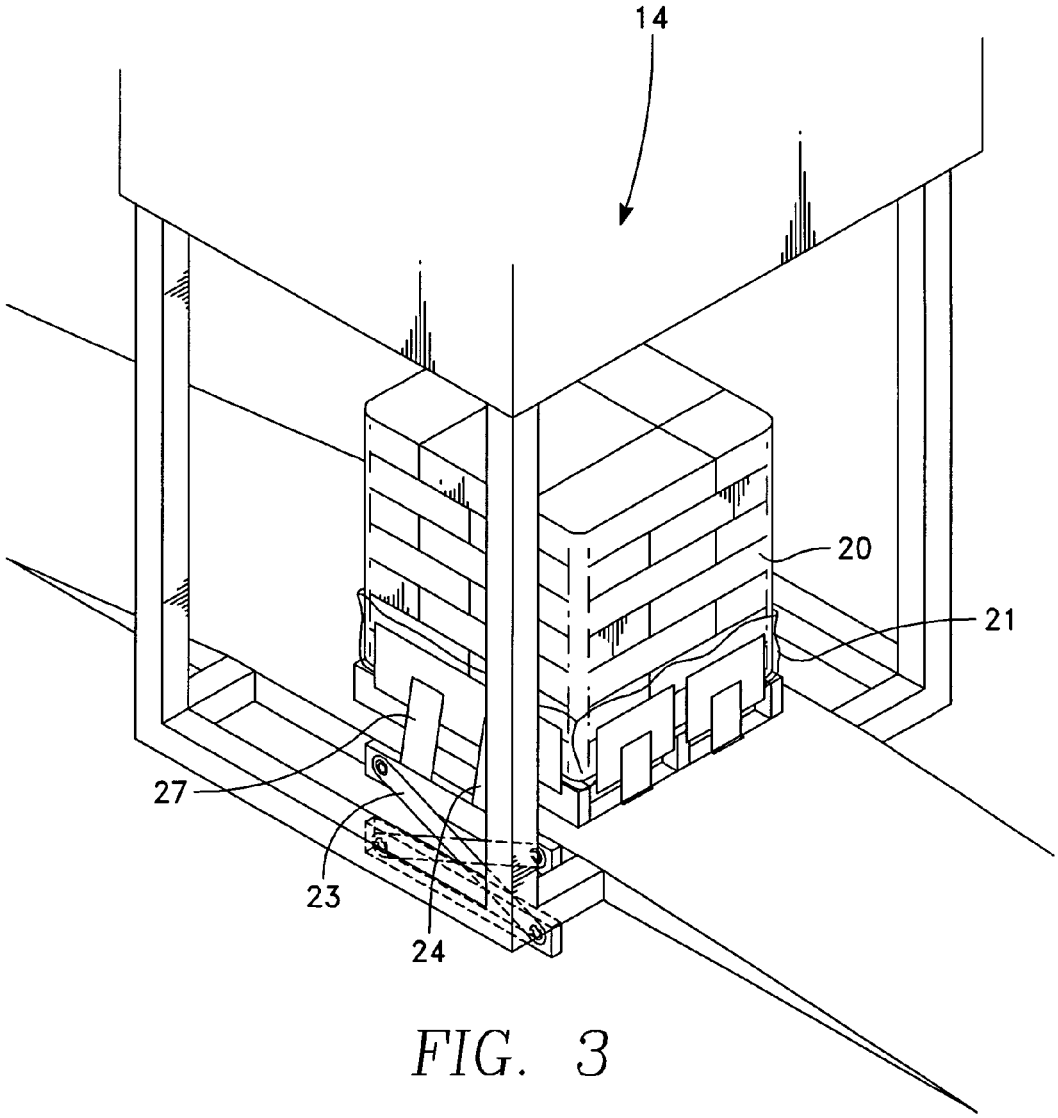
FIG. 3 shows a first embodiment of a system for positioning and holding the margins of a plastic pallet sheet vertically against the sides of palletized containers of perishables.
Figure 4:
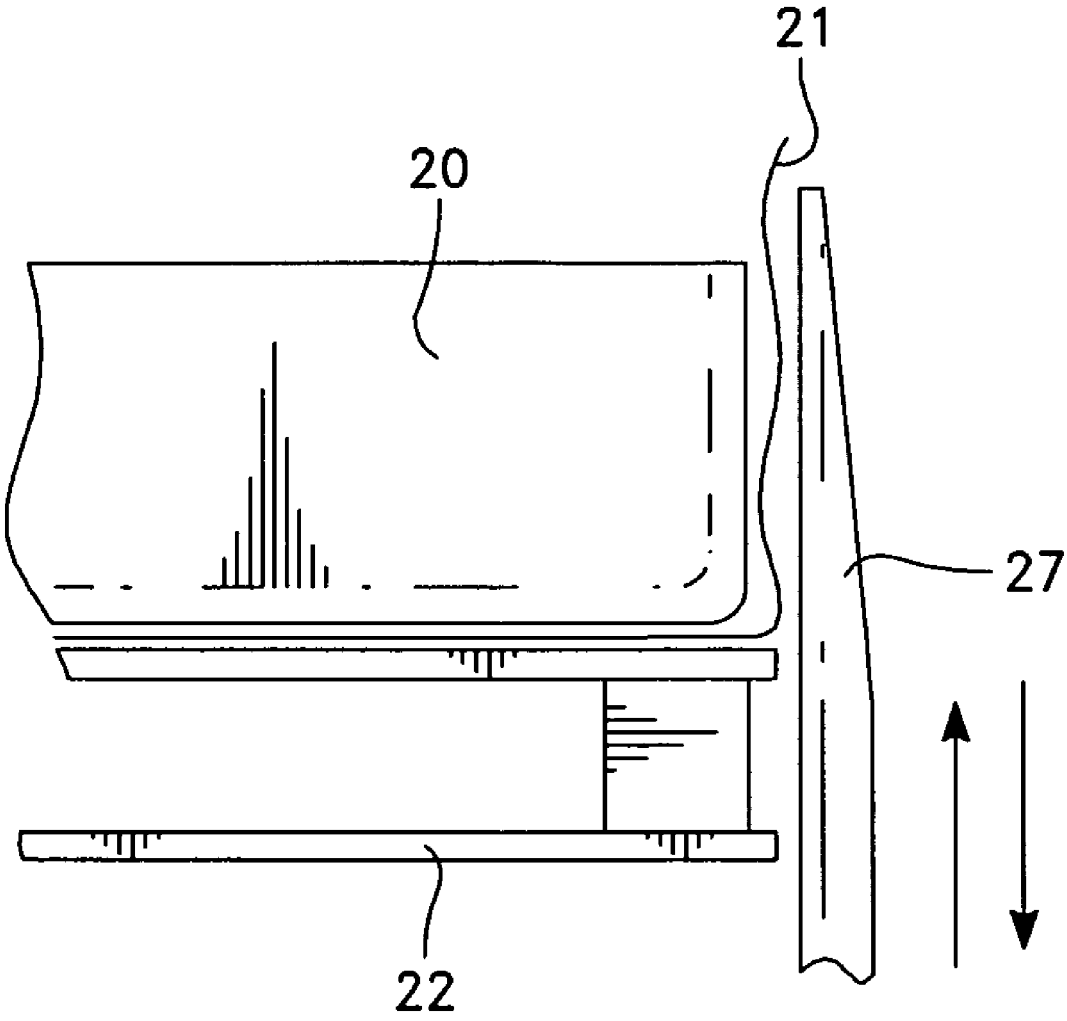
FIG. 4 shows a side elevation view of the plastic pallet sheet margins positioning/holding system device shown in FIG. 3.
Figure 5:
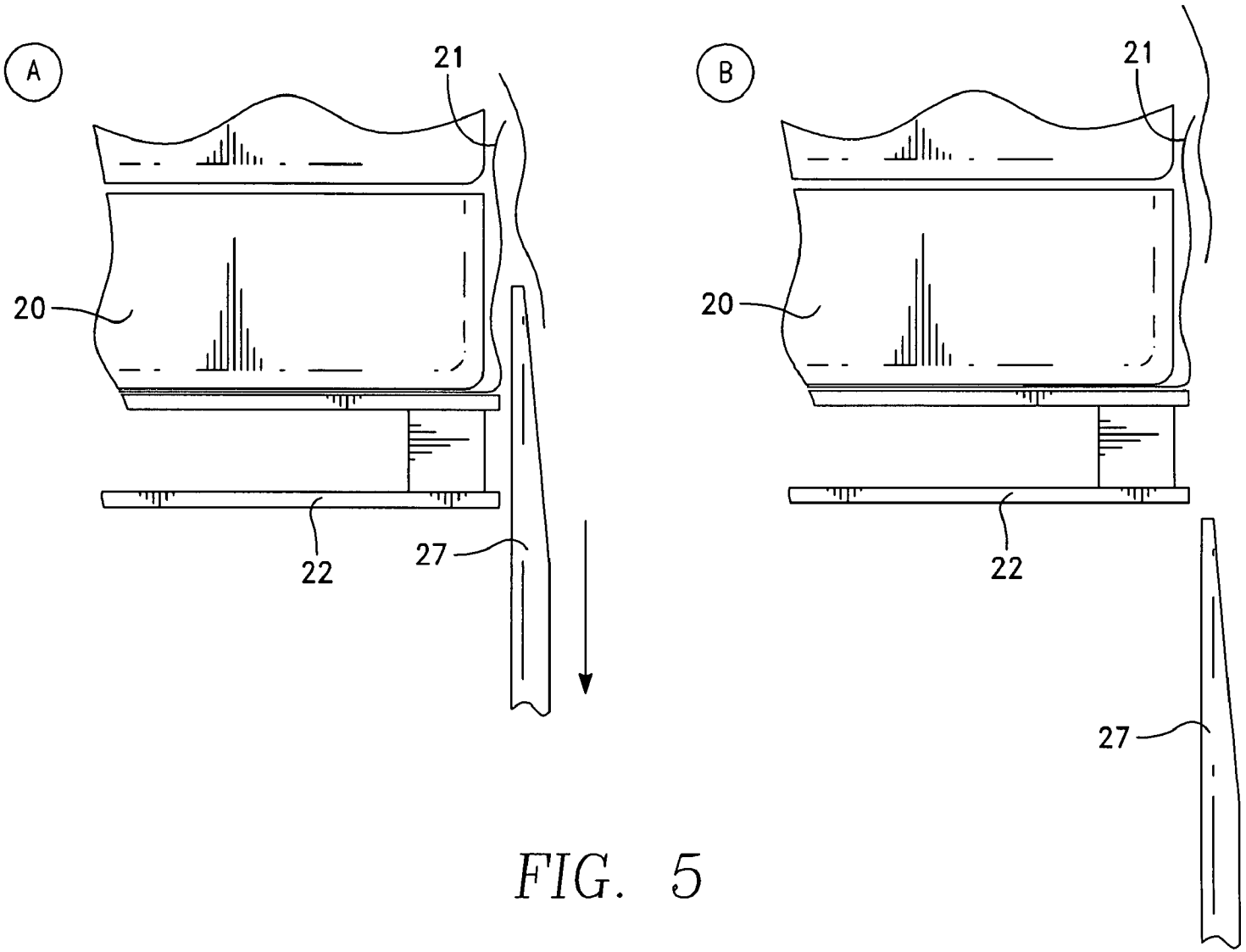
FIG. 5 shows the operation of the device shown in FIGS. 3 & 4.

FIGS. 3, 4 and 5 show scissors mechanism 23 which supports blades 24 and 27. As scissors mechanism 23 moves upward, blades 24 and 27 engage and move the margins of sheet 21 into the vertical position alongside the edges of the palletized load. These blades hold the margins in this vertical position until the bag has descended over the perishables, and over the margins of sheet 21. FIG. 4 shows blade 27 holding the sheet margins vertically against the side of the palletized load 20.

Figure 6:
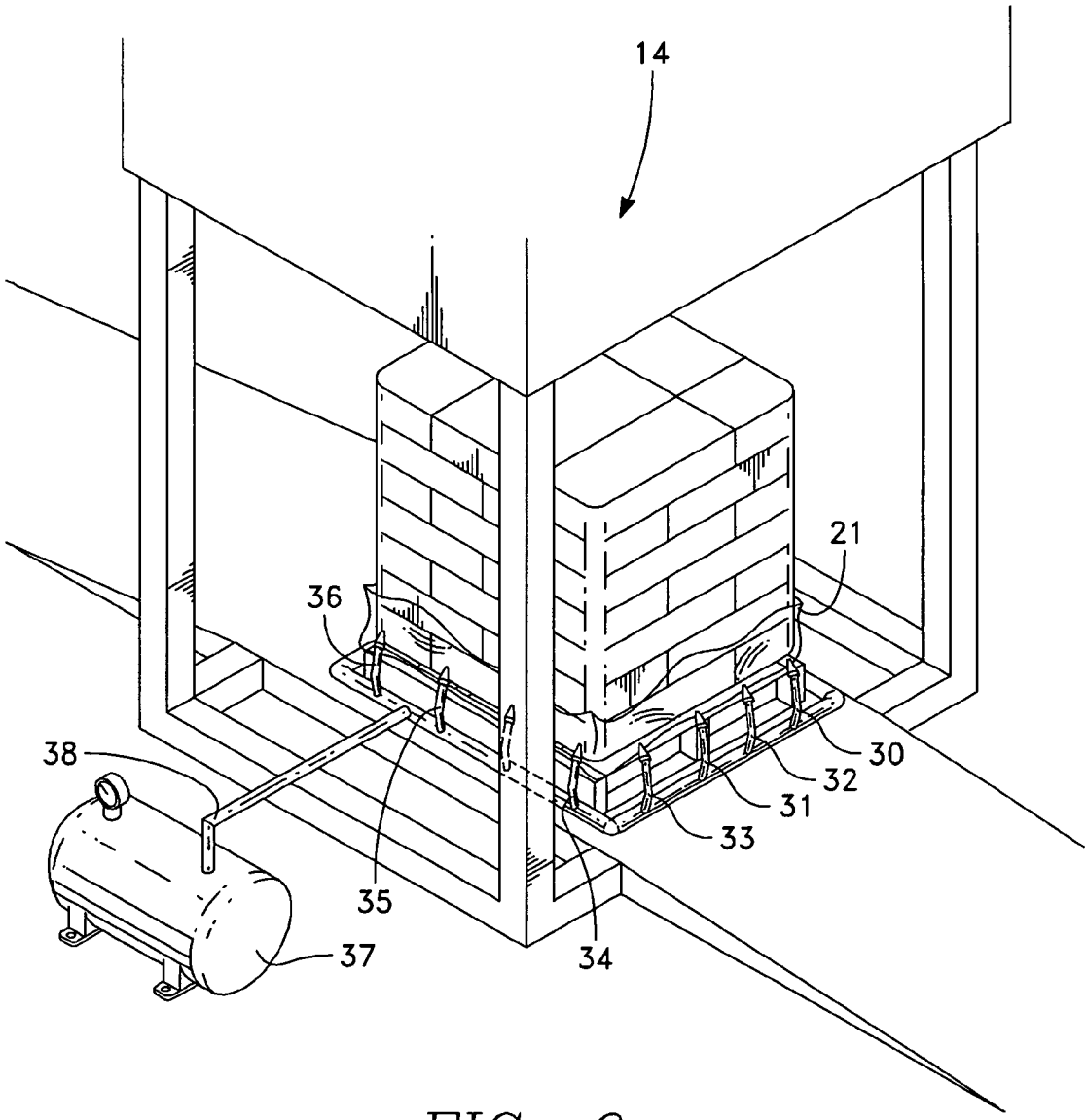
FIG. 6 shows a second embodiment of a device for holding the margins of a plastic pallet sheet vertically against the side of palletized containers of perishables.

FIG. 6 shows the margins of plastic sheet 21 alternately held in vertical position by means of air from blowers 30 through 36. This air is delivered from compressor 37 through manifold 38.

Figure 7:
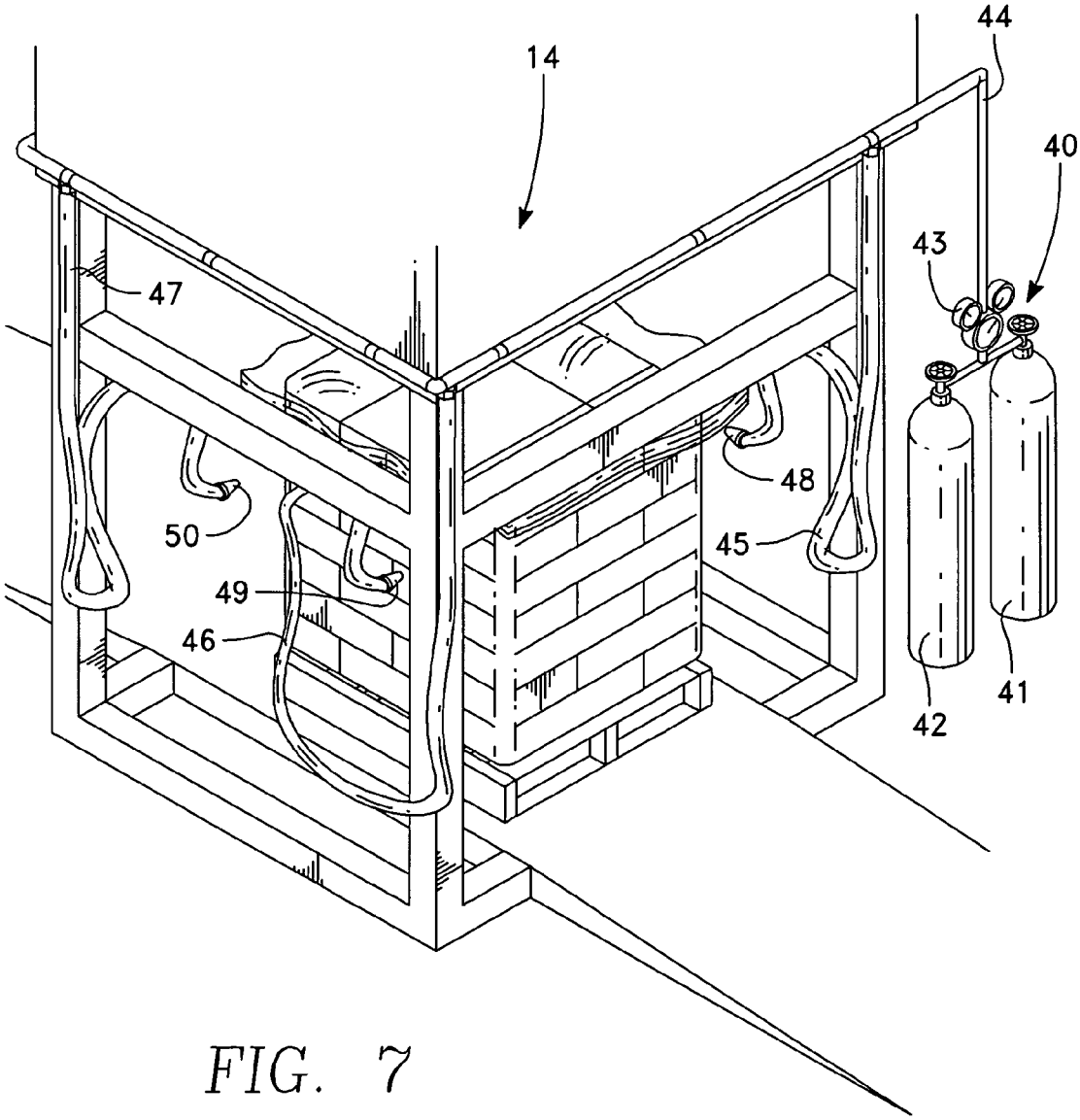
FIG. 7 shows an embodiment of a system for delivering one or more modified atmosphere gases under a bag as the bag descends over a palletized perishables load.

FIG. 7 shows gas delivery system 40, which includes gas tanks 41 and 42, valve 43, manifold 44, hoses 45, 46, and 47, and nozzles 48, 49, and 50. In preferred embodiments, this gas delivery system delivers one or more gases inside the pallet bag as it descends over the palletized load to form a desired modified atmosphere inside the bag.

Figure 8:
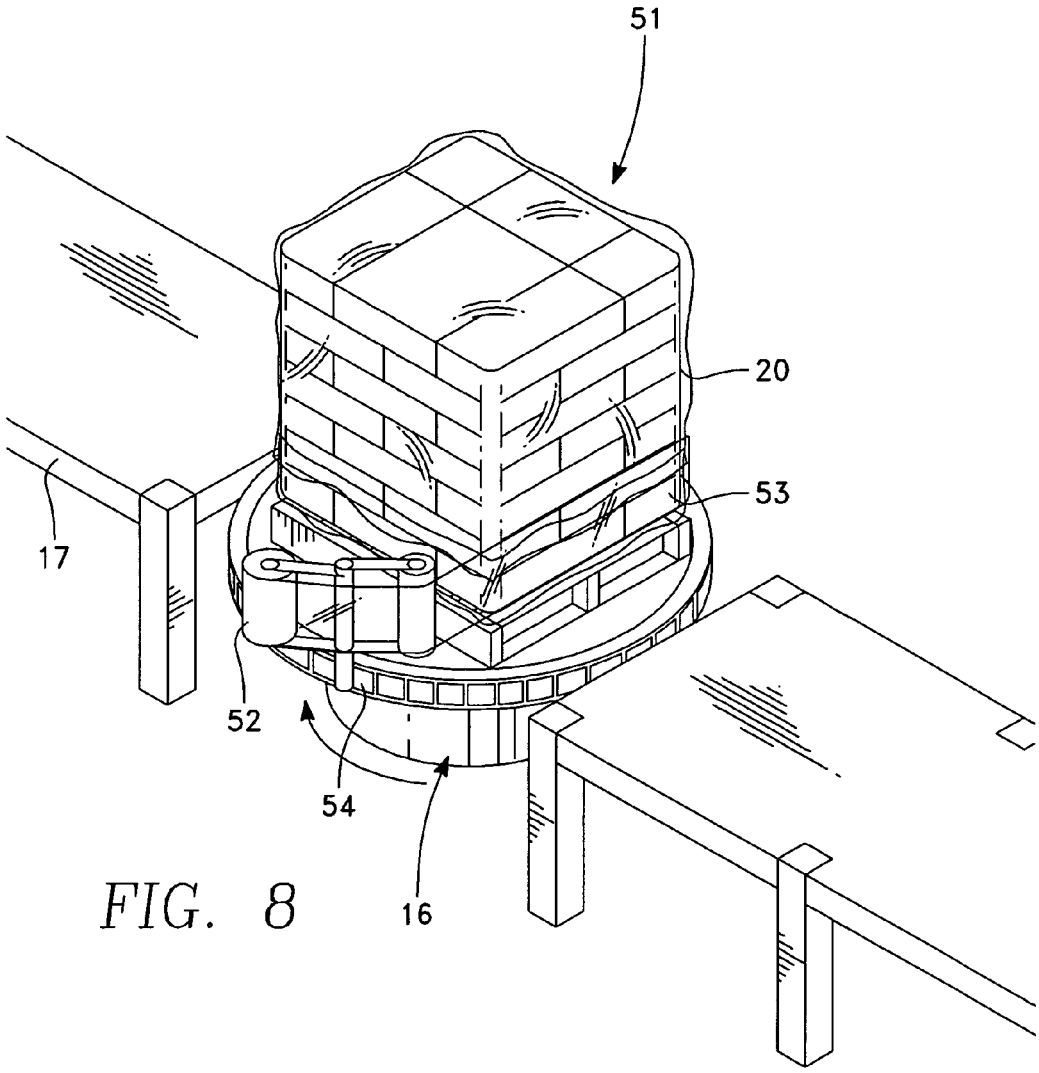
FIG. 8 shows an embodiment of a station for taping the opening of a plastic bag to the margins of a plastic sheet that are positioned vertically against containers of perishables atop a pallet and plastic sheet.

FIG. 8 shows unit 51, a bagged modified atmosphere-blanketed pallet of containers of perishables at taping station 16 where taping mechanism 52 applies tape to the periphery 53, where the bag overlaps vertically-extending deck sheet margins to seal them to one another. Alternatively, in FIG. 8, track 54 drives the tape mechanism around the pallet. The unitized load is stationery while the taping mechanism moves around the stationery load.

Figure 9:
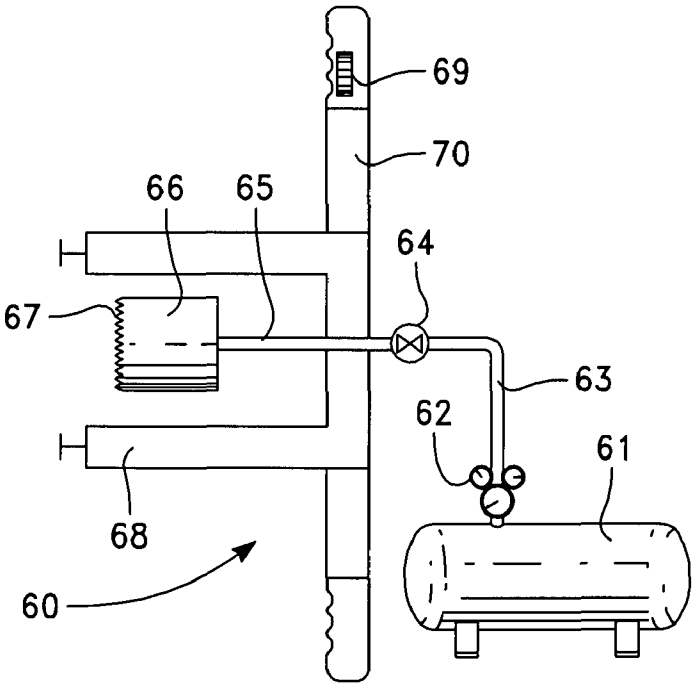
FIG. 9 shows a side elevation view of a system for forming one or more holes in bags placed over a palletized load of containers of perishables for purposes of forming and maintaining a desired modified atmosphere inside such bags.

FIG. 9 shows system 60 for forming calibrated holes in the bag as an adjunct to maintaining the desired modified atmosphere inside the bag. In FIG. 9, this system is located at station 19. Hole-forming system 60 includes air compressor 61, controls 62 and manifold 63, one-way valve 64, and hole-forming cutter 66 with serrated blades formed on surface 67. Cutter 66 is housed within safety collar 68 and is actuated by depressing switch 69 on handle 70.

Figure 10:
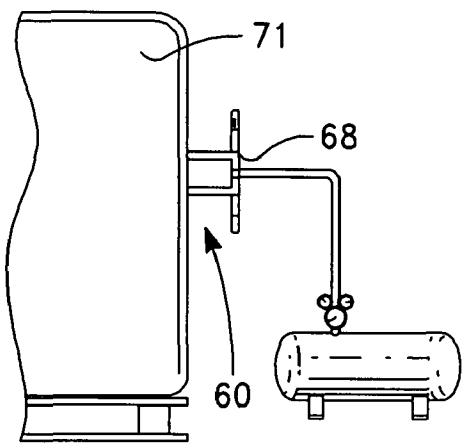
FIG. 10 shows the hole forming system of FIG. 9 in operation.
Figure 11:
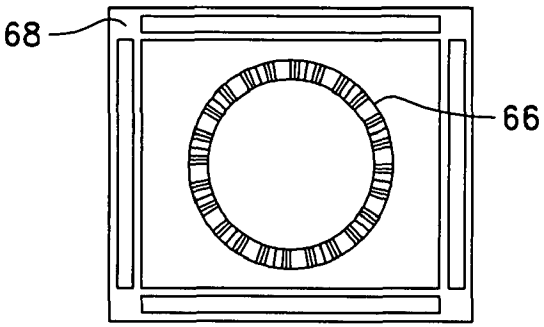
FIG. 11 shows a hole formed by the device shown in FIGS. 9 and 10.

FIG. 10 shows an elevation view of hole-forming system 60 applied against bag surface 70 of unit 71. With collar 68 resting against bag surface 70, cutter 66 moves (right to left) to cut into and form holes of desired shape and pattern on bag surface. Cutter 66 is withdrawn and a special membrane may then be applied to cover the hole.

After the hole-punch and the calibrated membrane application processes, the completed, bagged, unitized pallet containing a desired modified atmosphere moves along on exit conveyor 19. A forklift can then remove the unitized pallet load for storage/distribution.

FIGS. 10-A-D show a flow chart of a method for, and a schematic plan view of a largely automatic system 10E for applying a bag/enclosure to a pallet of containers of perishables, and for forming a modified gas atmosphere inside the resulting bagged/enclosed palletized container of perishables.

In system 10A conveyor 12A moves a plurality of pallets, each loaded with a plurality of containers of perishables, e.g., strawberry containers, stacked on the upper surface of the pallet. As an example, a pallet may carry 16 tiers, with six trays in each tier, and have an overall height of about 90 inches. Each tray may contain a plurality of strawberry baskets. The pallet itself may have a circumference in the range of 150 to 200 inches, and be rectangular or square in shape. Where the perishable is strawberries, the strawberries are preferably cooled to a temperature of about 33 degrees F. The perishables are preferably cooled to, and maintained at an optimum storage temperature, before the bagging operation begins.

A plurality of pallets, each loaded with perishables, may be brought to in-feed 12A, e.g., by forklift 18A. In-feed 12A automatically conveys the pallets, one at a time, to squeeze station 100.

Figure 10A:
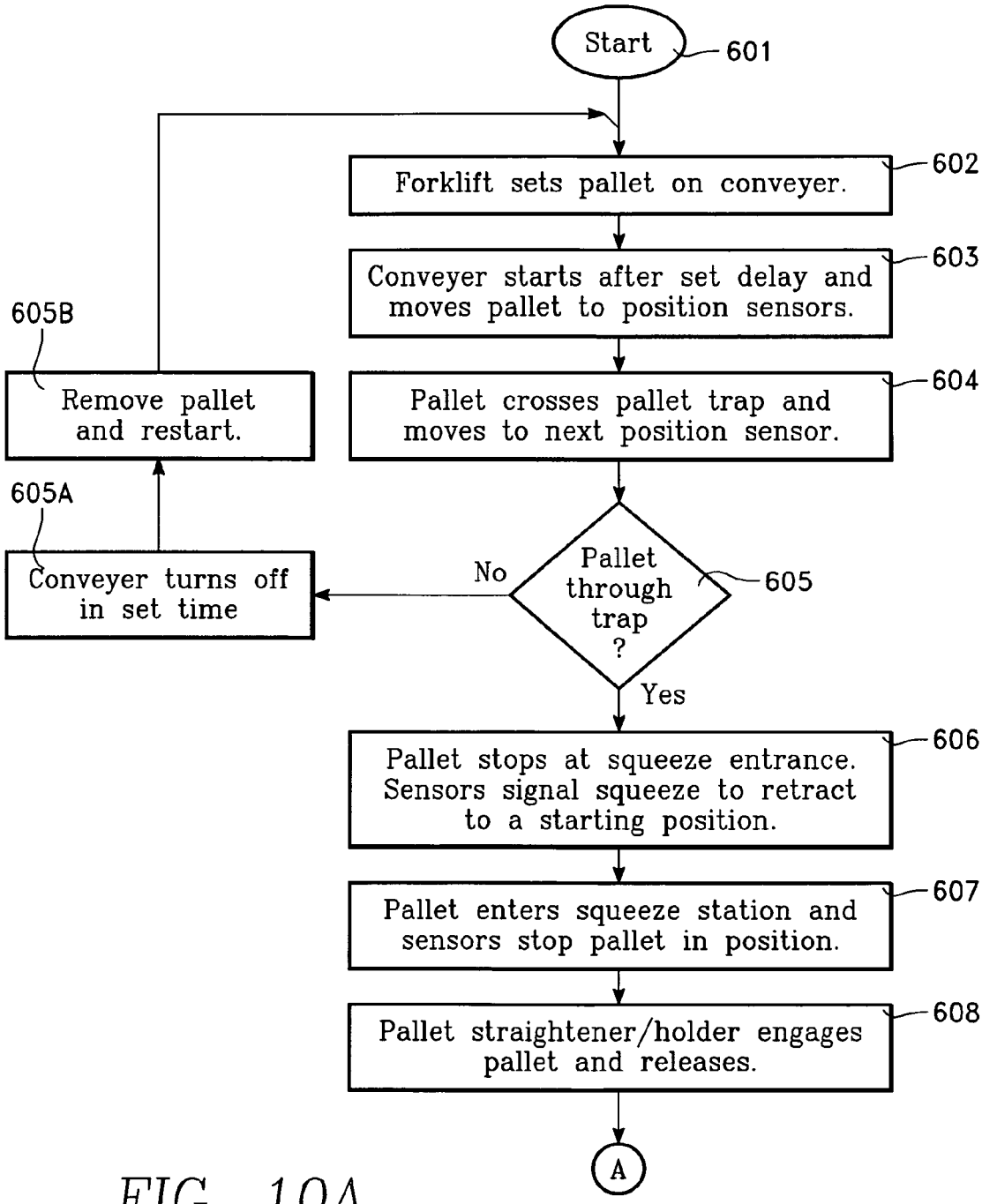
FIGS. 10A-D are a flow chart of a preferred embodiment of an automatic method and system for applying a bag/enclosure to a pallet of containers of perishables, and for forming a modified gas atmosphere inside the bag/enclosure.
Figure 10B:
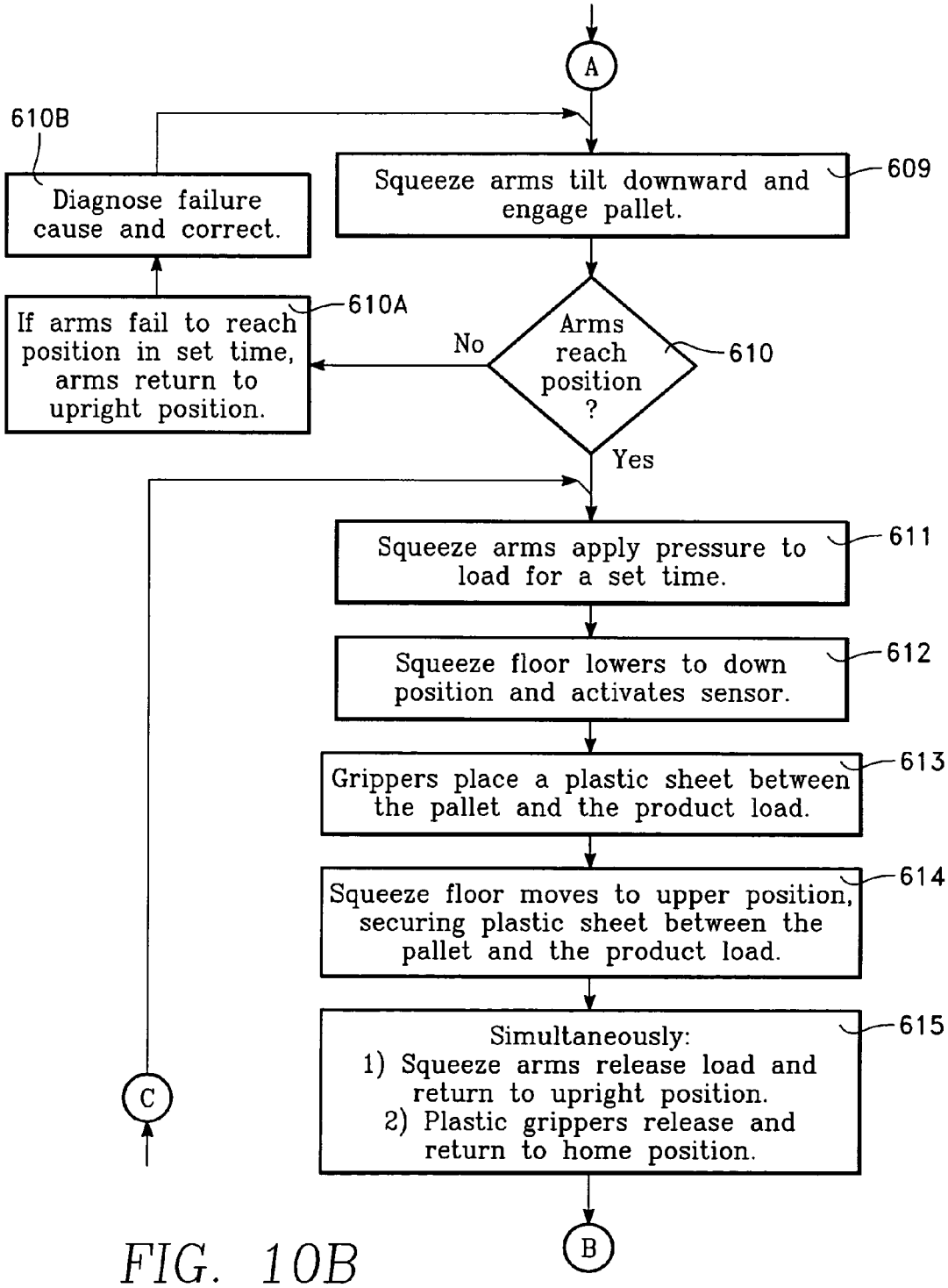

See FIG. 10A, steps 601 to 608 and FIGS. 12A-12E. At squeeze stations 100, one or two pairs of opposed, hydraulically actuated, vertical walls 101 and 102 are automatically activated to engage and squeeze the pallet load of containers of perishables 106 above the pallet with sufficient force to permit the floor plate beneath the pallet to be lowered from the load supporting position, or to raise the pallet load from the pallet. See, e.g. Bolejack, et al. U.S. Pat. Nos. 5,014,495, 5,046,302; 5,111,639, and 5,314,286; Forgnone, et al. U.S. Pat. No. 6,532,717; and MacLeod, et al. U.S. Pat. No. 4,821, 489, describing such methods and apparatus. After the pallet 105 and load 106 have been separated from one another, a plastic sheet 107 is automatically placed on the pallet 105 in the gap formed between the unitized load 106 and the pallet 105. The inserted sheet 107 then rests on the pallet's upper surface 108. This sheet 107 is generally flat, and the margins of the sheet 107 extend beyond the edges of the pallet 105. After placement of the sheet 107 on the pallet 105, the pallet 105 may then be raised, or the pallet load 106 may be lowered, to replace the perishables containers onto the plastic sheet 107 atop the pallet 105. The pallet 105, with its plastic sheet 107 and perishables 106 atop the plastic sheet, is then conveyed into plastic sheet folding and sealing station 200. See FIGS. 10B-10C, steps 609-616.

Figure 10C:
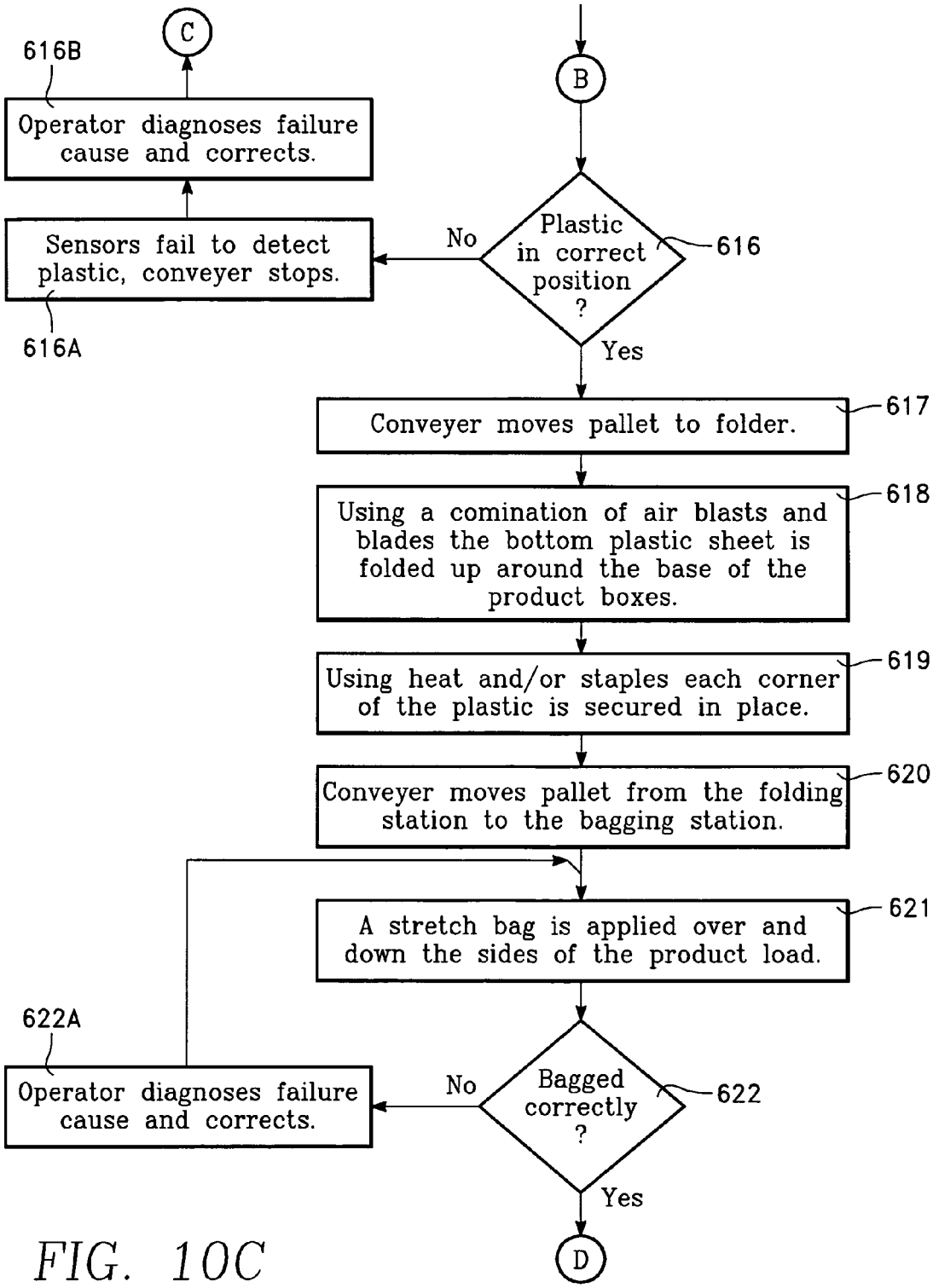

See FIG. 10C, steps 617-619 and FIGS. 13A-13F. At station 200, the sheet margins 107 that extend beyond the four sides of the pallet 105 are folded upwardly by air flow emitters 201 and pusher rods 202 against the palletized load of perishables, forming four corner folds, and then each corner fold is heat sealed by moveable/retractable heating elements 203 which move inwardly to engage, and heat seal the four folds, then retract when heat sealing is completed; see FIG. 13F.

See FIG. 10C, steps 620-623, and FIGS. 14A-14F. Thereafter, the palletized load is automatically conveyed to bagging station 300, where a plastic bag/enclosure 302 of appropriate size, shape, type and gas permeability is automatically applied. The bag/enclosure descends from a supply 301 above the pallet of perishables, and is stretched by elements 303 to fit over the palletized perishables, and the upwardly folded margins of the pallet sheet. The margins at the opening of the bag may be positioned above the pallet, leaving a portion of the vertically-extended sheet margins exposed. Because the bag has been stretched, and released against the load, the elasticity of the bag pulls tight against, and holds the vertically positioned margins of the sheet in place. Bagging apparatus of this type are, for example, the automatic Lachenmeier, Beumer, and Moeller stretch hood machine. The palletized, bagged/enclosed load of perishables 106 is weighed by scale 304, and the weight is used to determine the modified atmosphere to be placed inside the bag/enclosure.

Figure 10D:
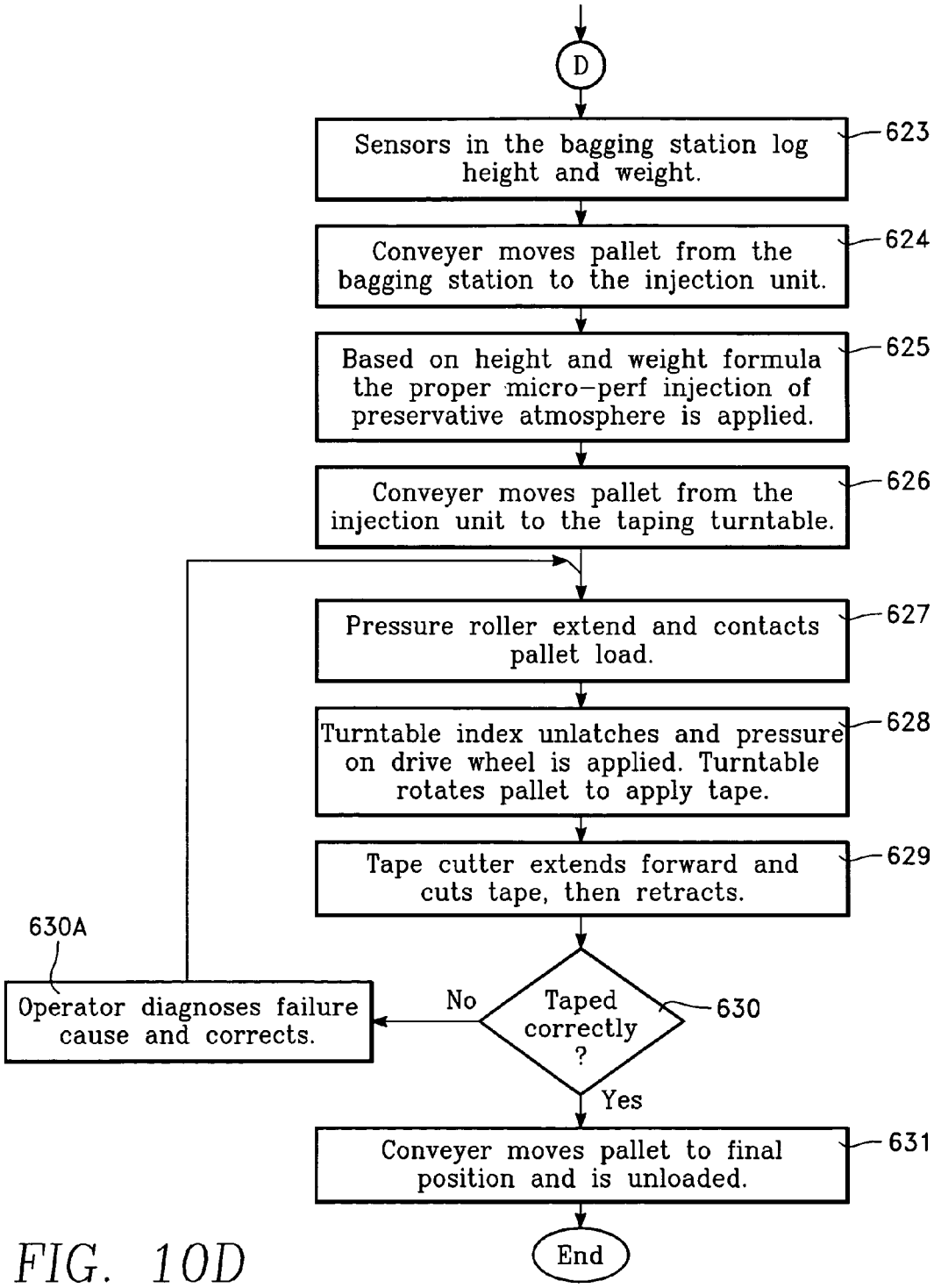

See FIG. 10D, steps 624-625 and FIGS. 15A-15D. After the automatic bagging/enclosing is completed, the system conveys the bagged/enclosed, palletized load of perishables 106 to a gasifying station 400. There, one or more gasses appropriate for creating a desired modified atmosphere inside the bag, and over the perishables, may be injected inside the bag with an injector device that pierces the bag, and delivers the desired gas(ses) in appropriate quantities. The injector device may include a plurality of nozzles/needles 401 mounted on plates 402 that reciprocate on elements 403 into, and out of engagement with the enclosure/bag, piercing the bag/enclosure, and delivering appropriate gas(ses) inside the bag/enclosure that is stretched over the perishables load. As flow chart 10D shows, the nature and quantities of gas(ses) delivered inside the bag/enclosure are based on the height and weight of the palletized perishables, which the system measures, on the number and size of the holes formed in the bag/enclosure, and on the nature of the perishables, and may be calculated with a computer program that utilizes a look-up table to determine the nature and quantity of gas(ses) to be delivered inside the bag.

Figure 16A:
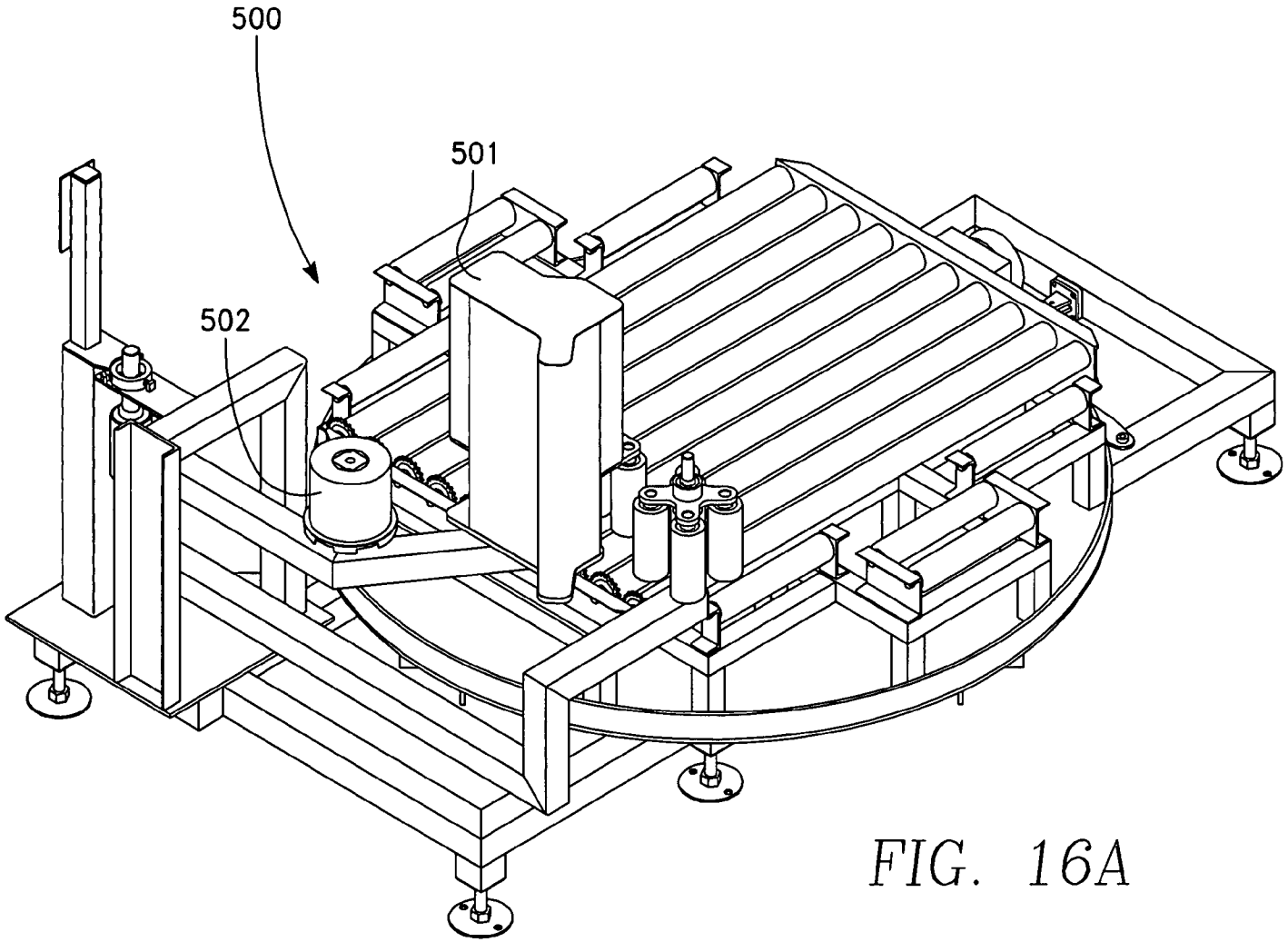
FIGS. 16A & B show the structure and operation of the automatic taping station 500 for the enclosed/bagged palletized perishables in modified atmosphere shown in FIG. 11A.
Figure 16B:
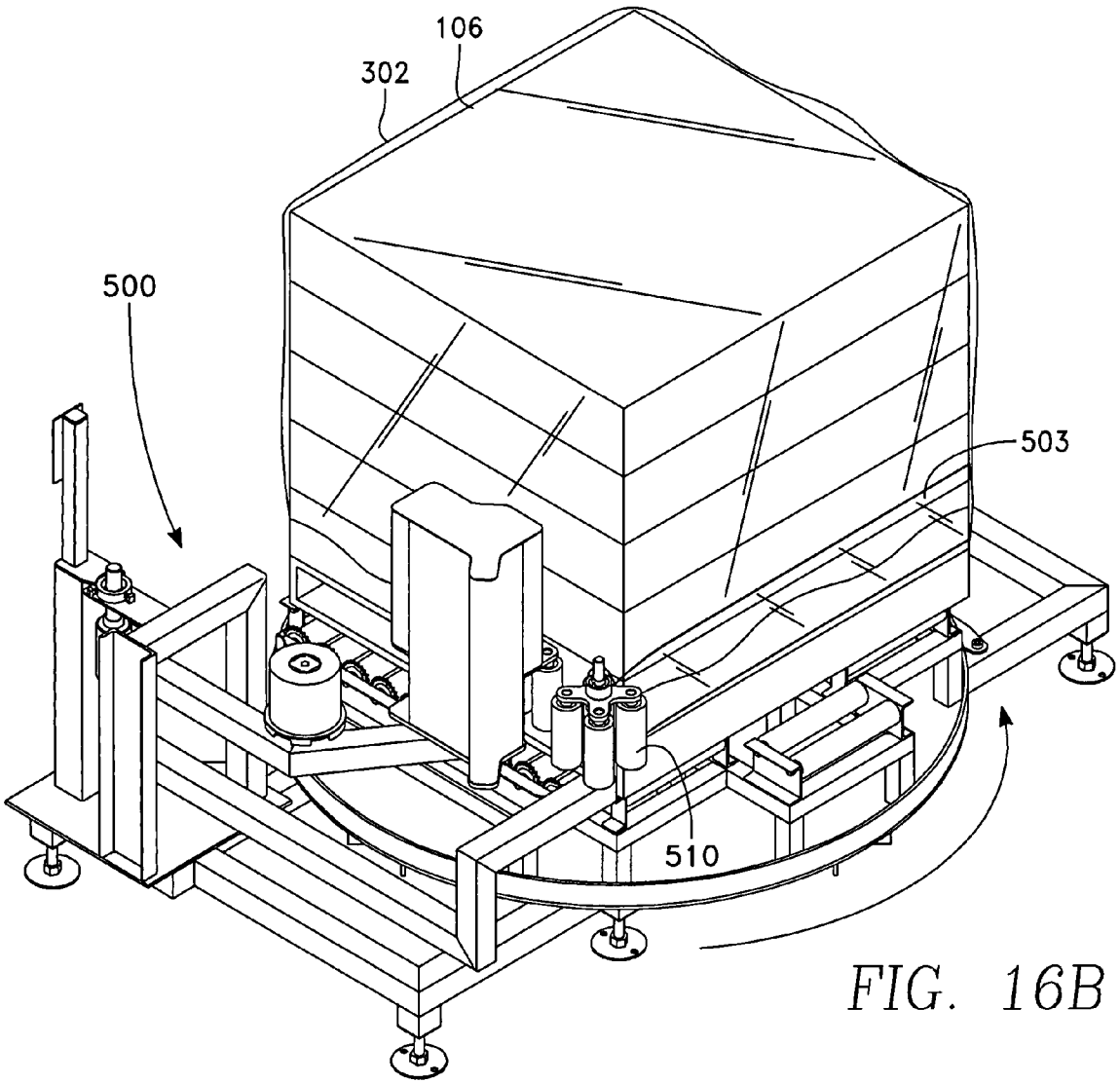

See FIG. 10D, steps 626-630 and FIGS. 16A-16B. The bagged/enclosed palletized perishables are then automatically conveyed from gasifying station 400 onto a tape turntable at sealing station 500. There, a taping mechanism 501 applies tape 502 or other suitable material where the bag/enclosure overlaps the upwardly folded pallet or decking sheet, as the palletized containers are rotated with respect to the tape application, preferably around the entire circumference of the bagged palletized containers of perishables in a continuous band, creating a substantially air-tight seal 503.

Tape head 502 moves in a plane parallel to the sides 106 of the palletized containers to contact the leading corner of the pallet unit. The leading edge of tape adhesive surface is delivered from a plane parallel to the sides 106 of the palletized containers, and is pressed against and tacks to the overlapping margin of the decking sheet and the plastic bag/enclosure. The height of the tape is pre-positioned to cover this margin. The pallet rotates, pulling tape off a tape roll and through dispenser roller heads and mechanisms 510. Pressure rollers 510, which follow behind the tape dispensing head press and adhere the tape to the overlapping margin of the bag/enclosure and the decking sheet, creating a seal. The dispensing head and pressure rollers articulate around pallet corners as the pallet rotates. After a 360 degree rotation, the palletized perishables stop rotating. The tape dispenser moves away from the palletized perishables, e.g., by about 6 inches.

An automatically actuated pressure rod pulls the tape tightly between two rollers which are positioned in parallel inside the tape dispenser head. Taut tape is automatically cut in a plane parallel to the sides of the palletized perishables with an air actuated knife. The tape head dispenser then moves out and away from the palletized perishables. Thereafter, the sealed palletized perishables unit exits the sealing station.

Figure 11A:
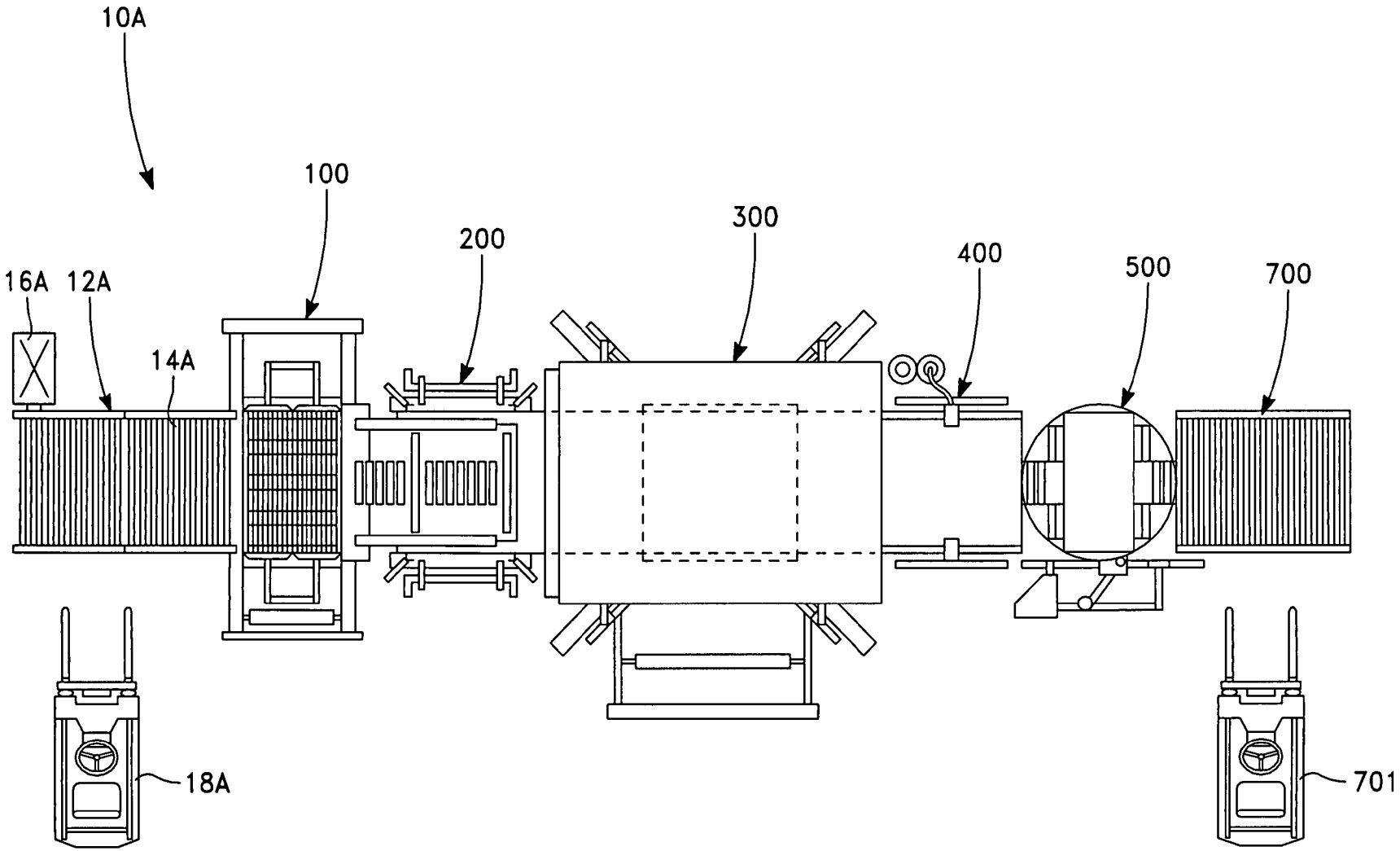
FIG. 11A is a schematic diagram of the automatic method and system of FIGS. 10A-D, showing the separate stations for sealing the pallet sheet margins against a palletized load of perishables, for applying a bag/enclosure to the palletized load, for injecting the appropriate gas(ses) in appropriate quantities into the bagged/enclosed, palletized perishables, and for taping the bag/enclosure to the bottom sheet margins.
Figure 12A:
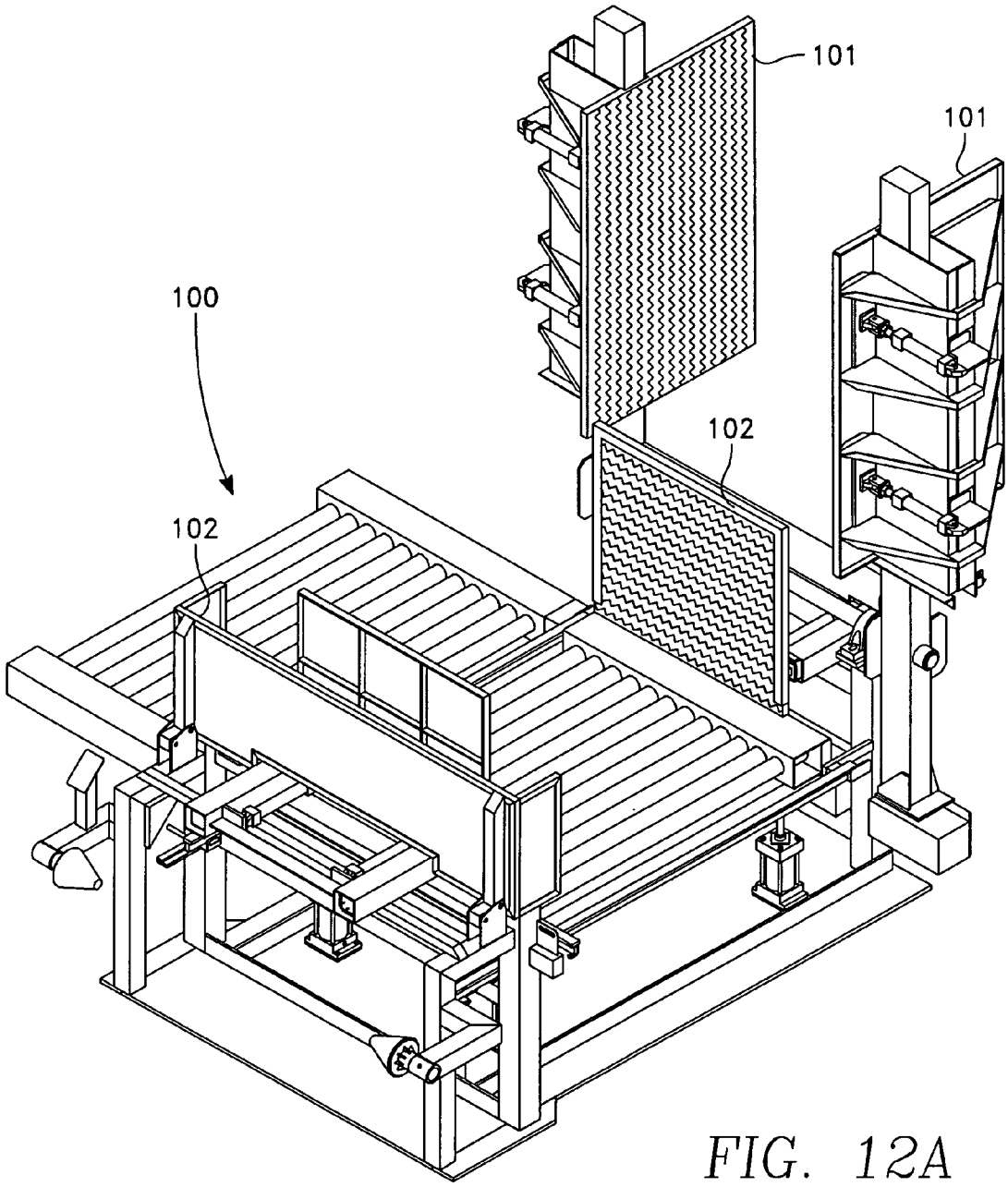
FIGS. 12A-E show several views of the structure and operation of the palletized load squeeze station 100 shown in FIG. 11A.
Figure 12B:
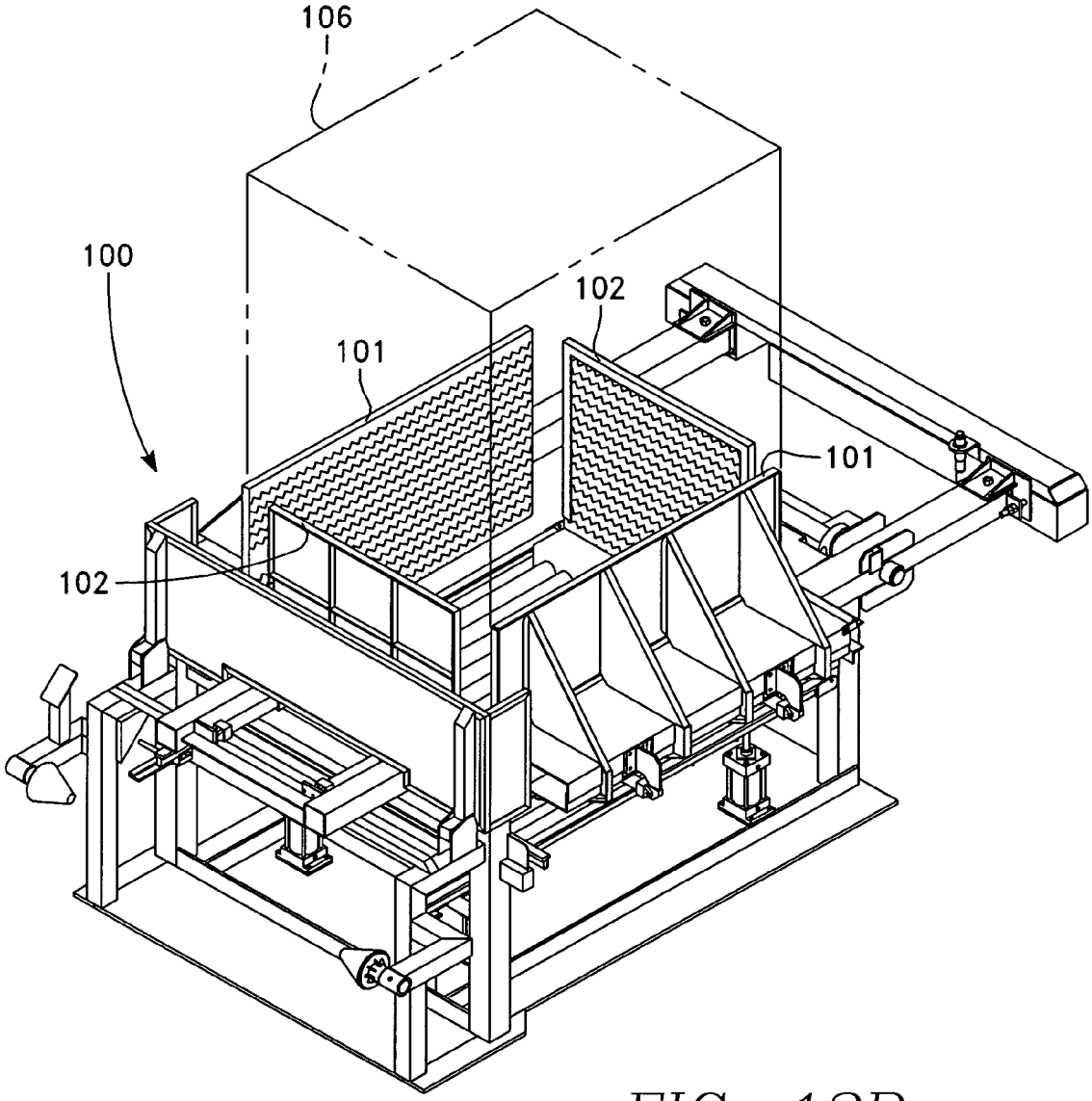
Figure 12C:
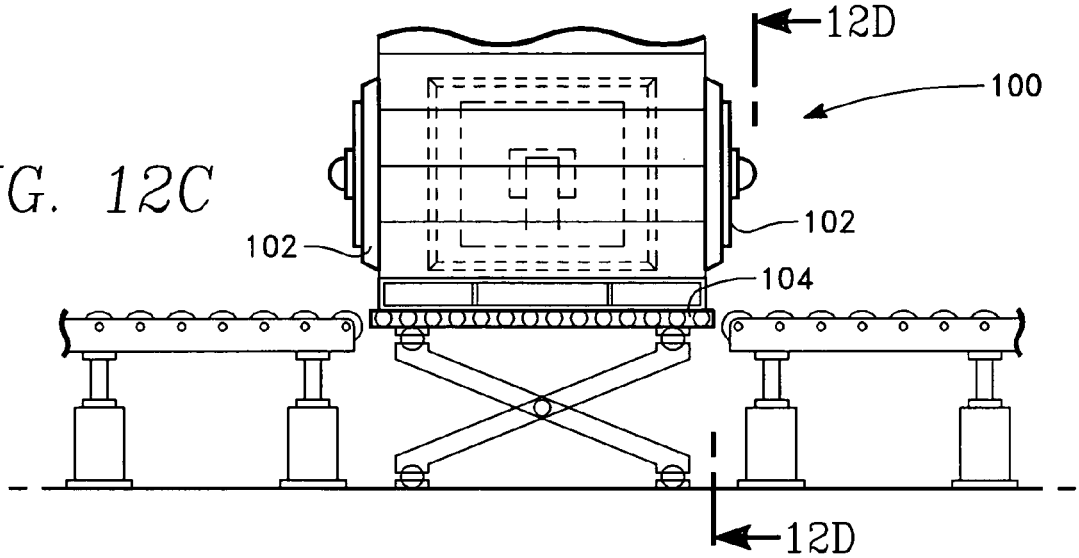
Figure 12D:
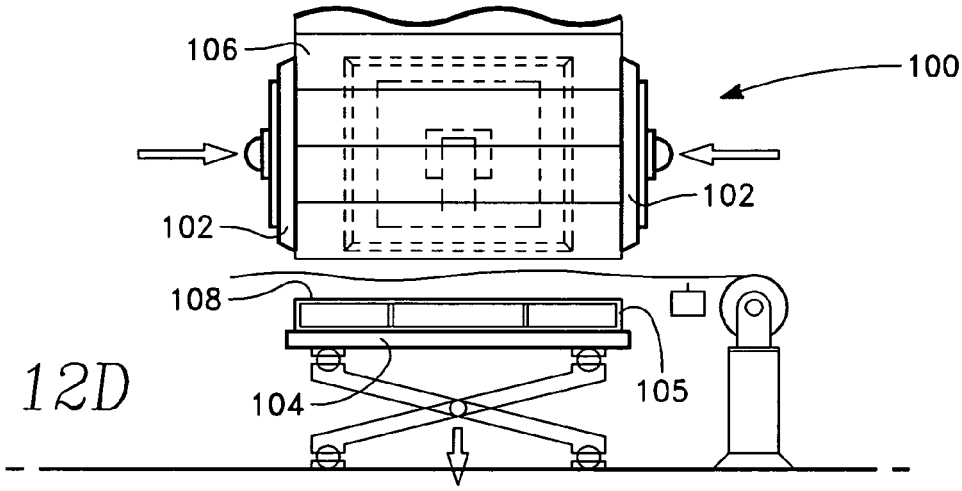
Figure 12E:
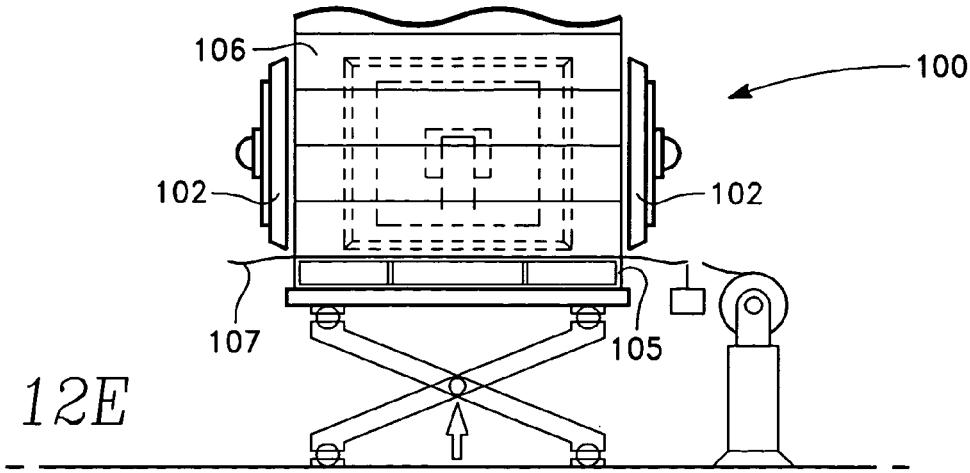
Figure 13A:
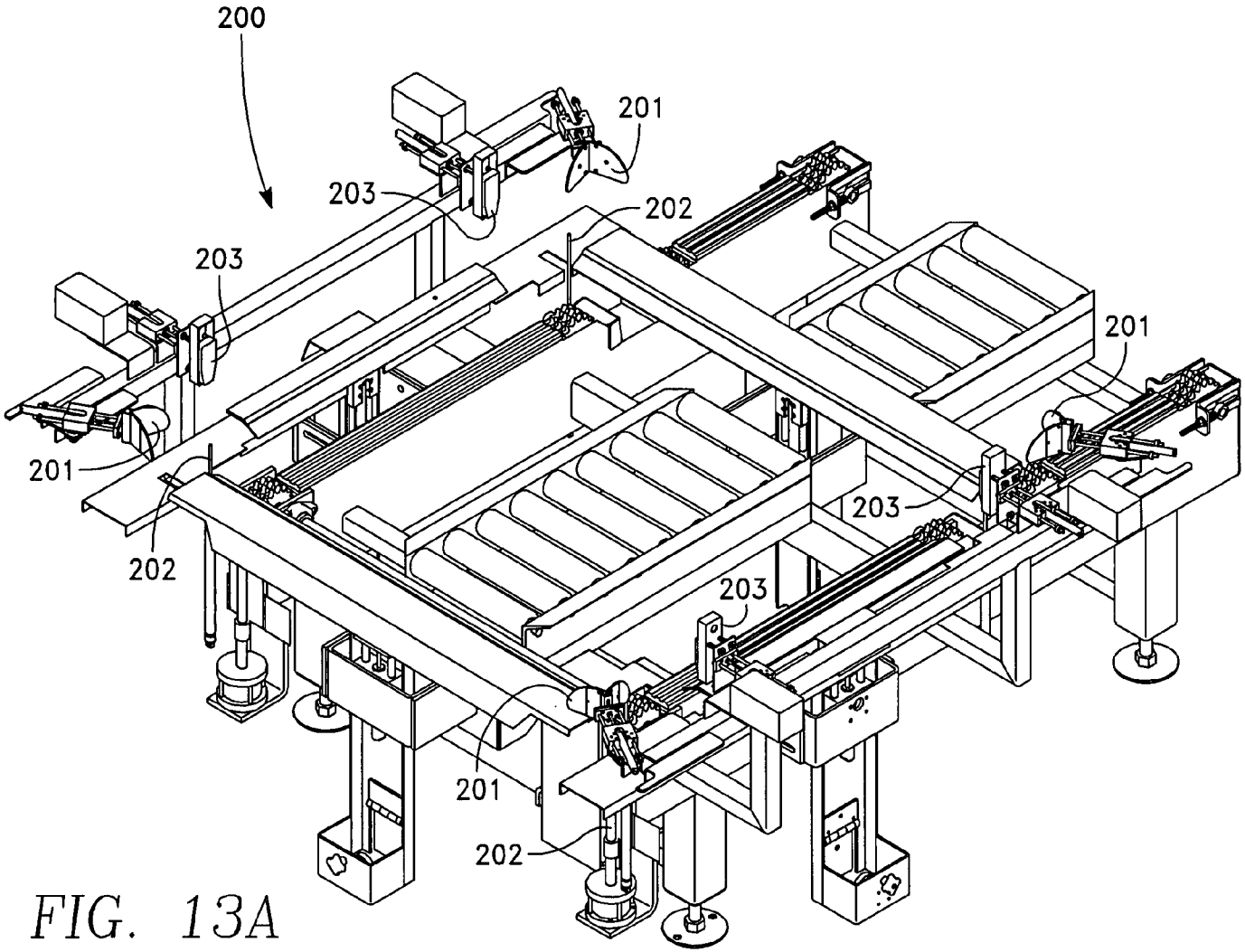
FIGS. 13A-F show several perspective views of the construction and operation of the bottom sheet placement, folding and heat sealing station 200 shown in FIG. 11A.
Figure 13B:
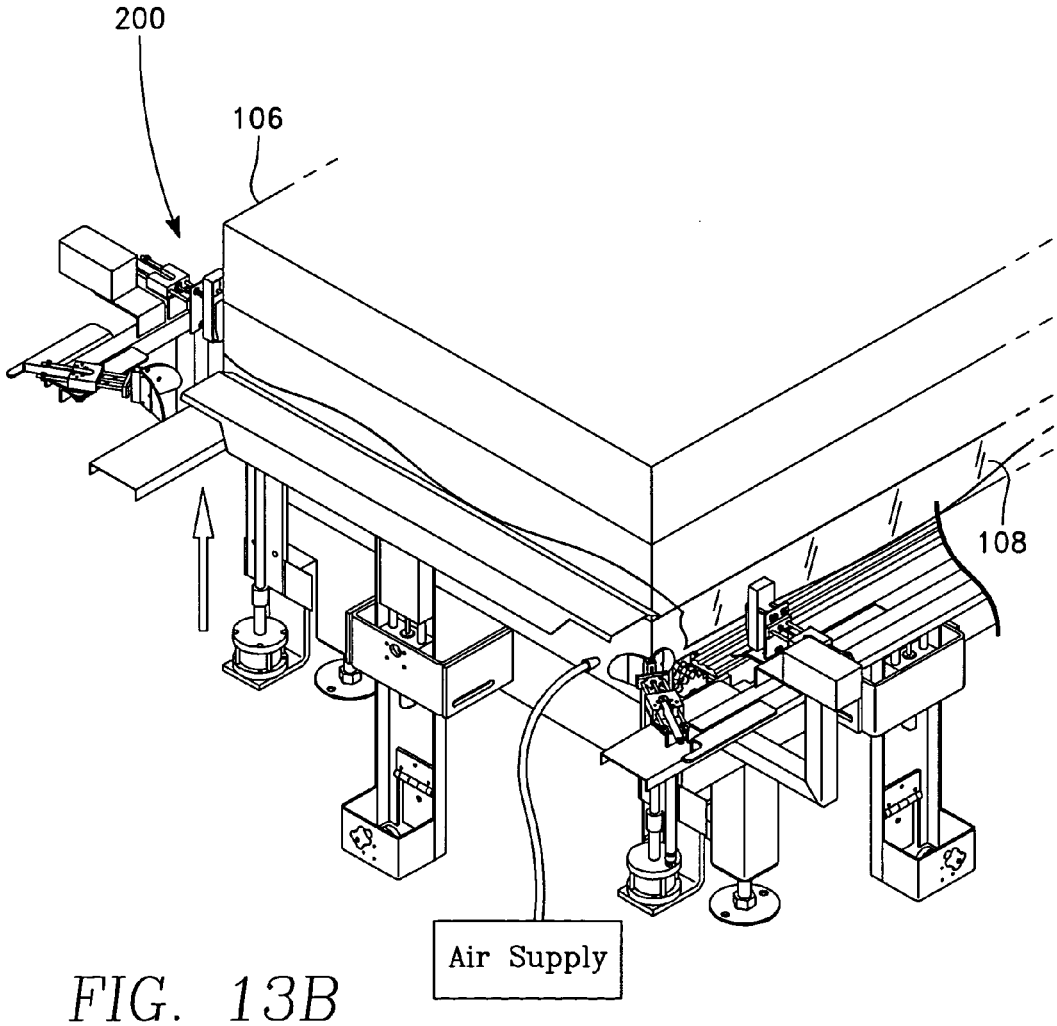
Figure 13C:
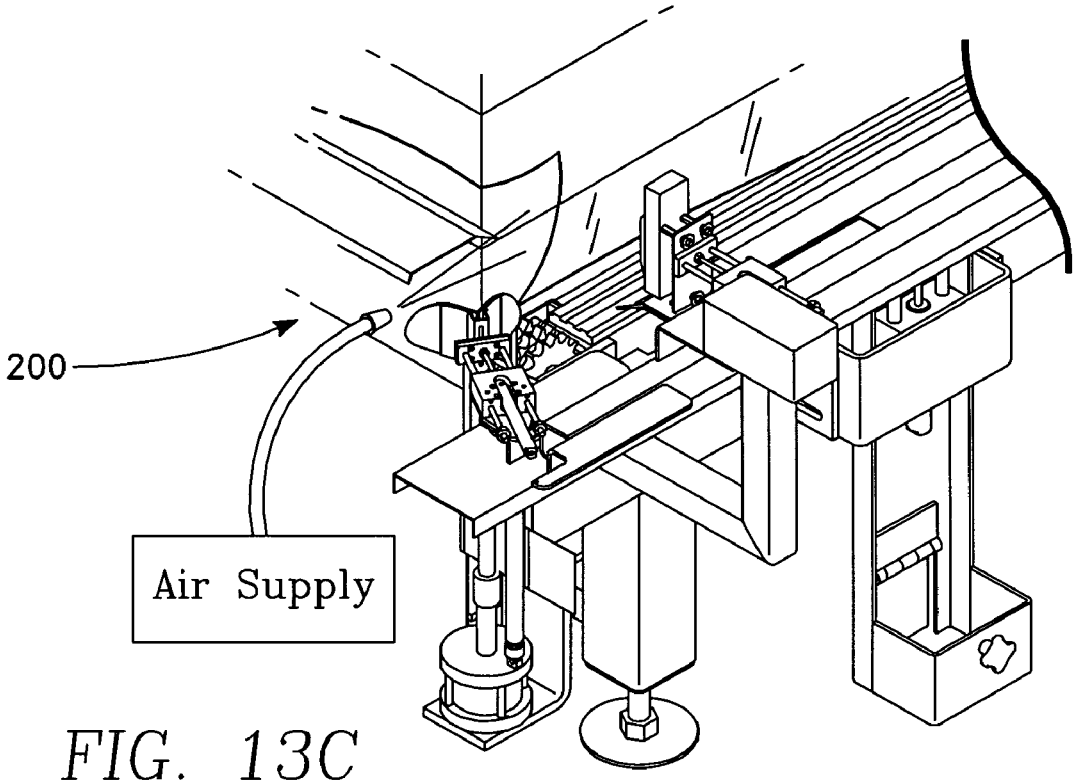
Figure 13D:
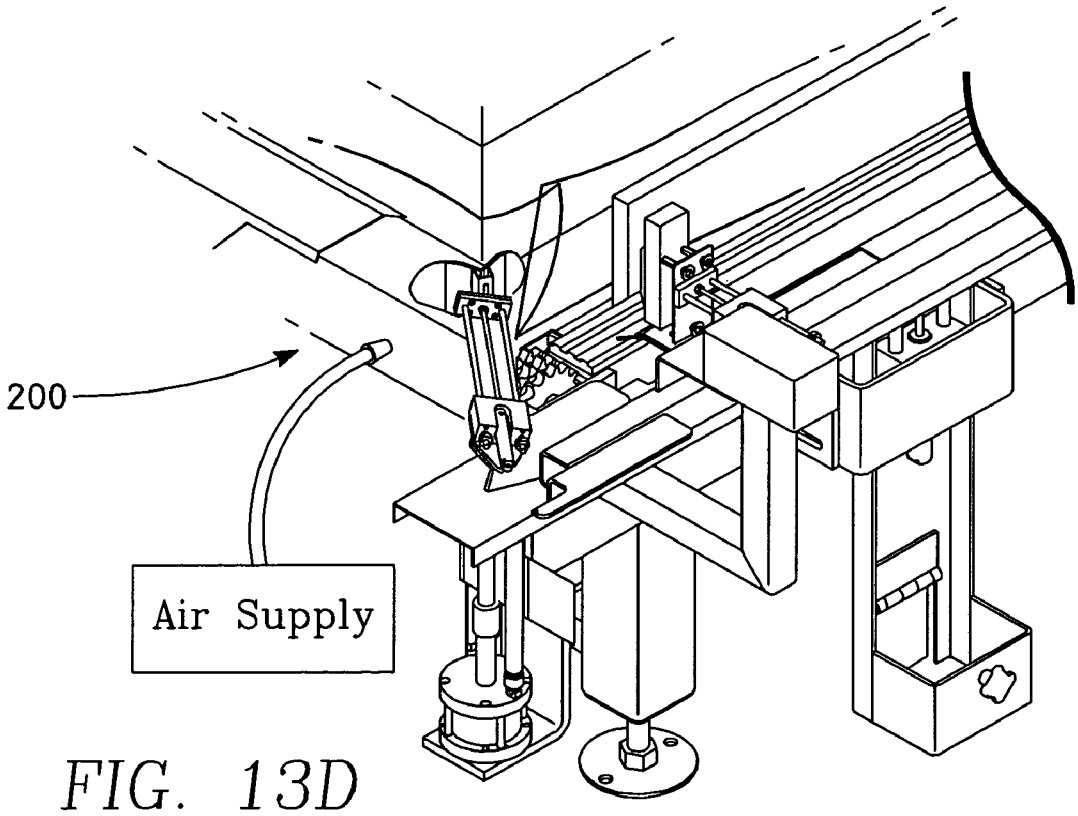
Figure 13E:
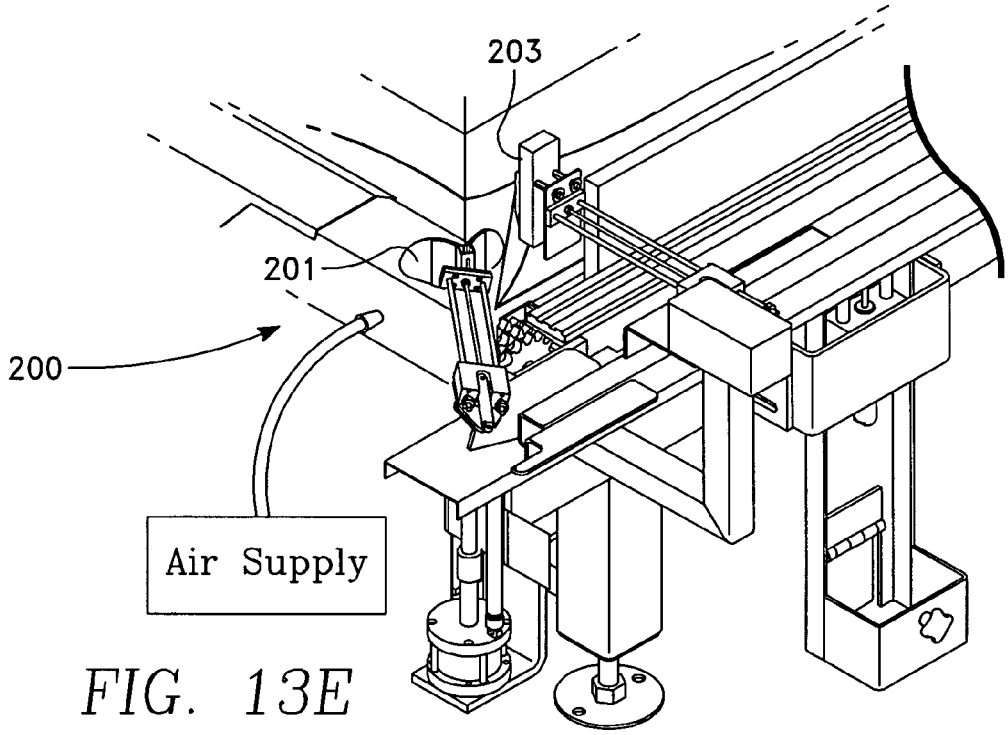
Figure 13F:
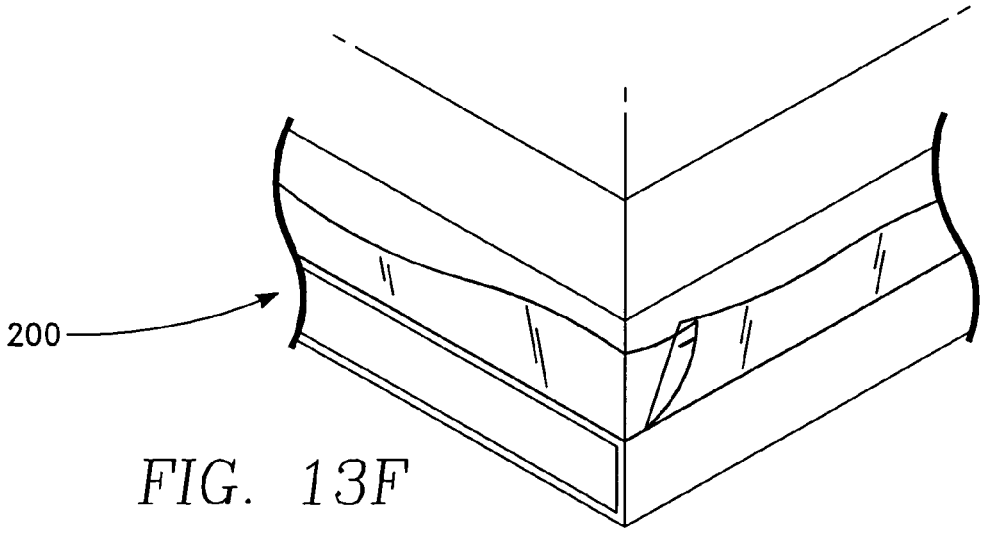
Figure 14A:
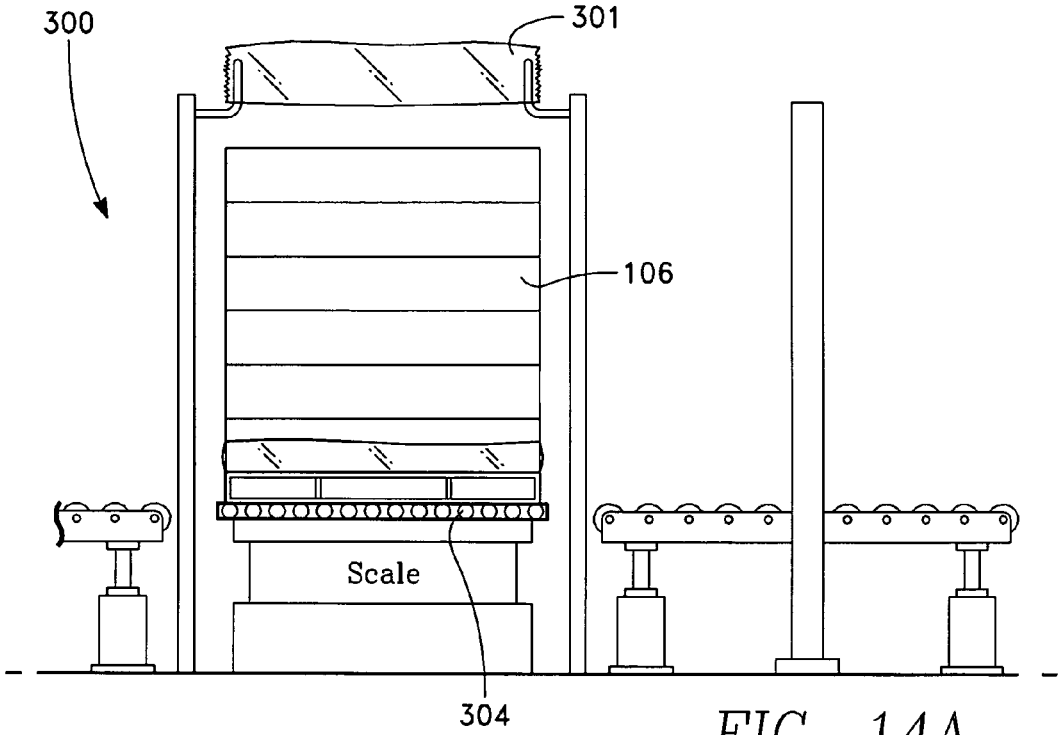
FIGS. 14A-F show several elevation views of the structure and operation of the automatic bag/enclosure forming station 300 shown in FIG. 11A.
Figure 14B:
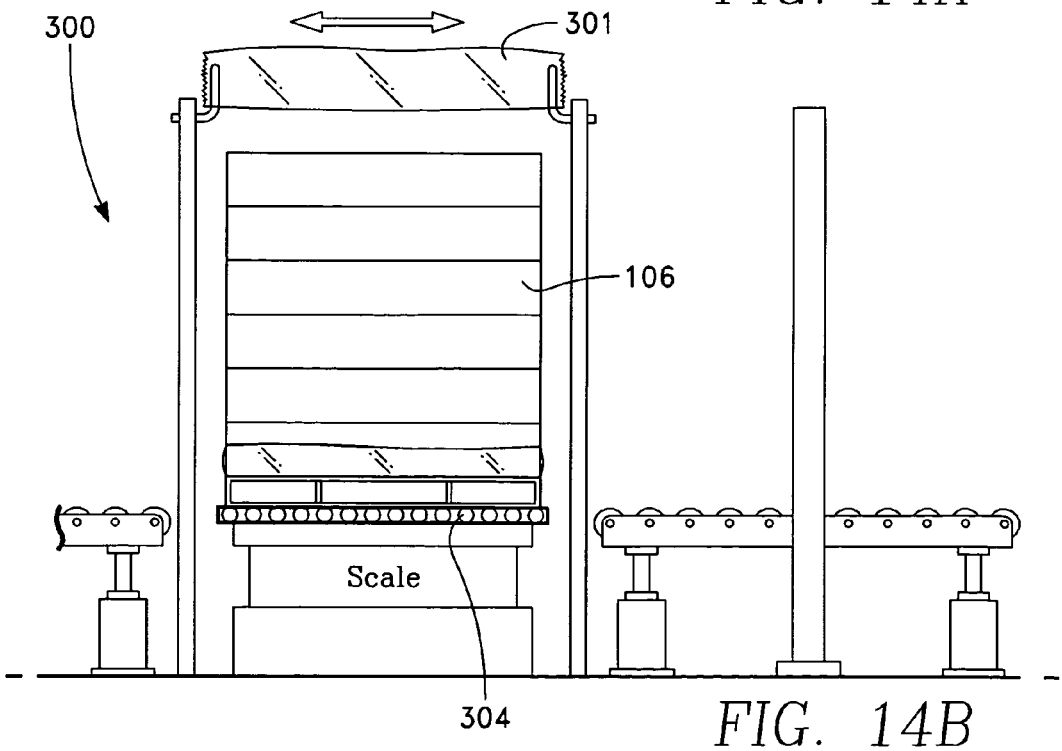
Figure 14C:
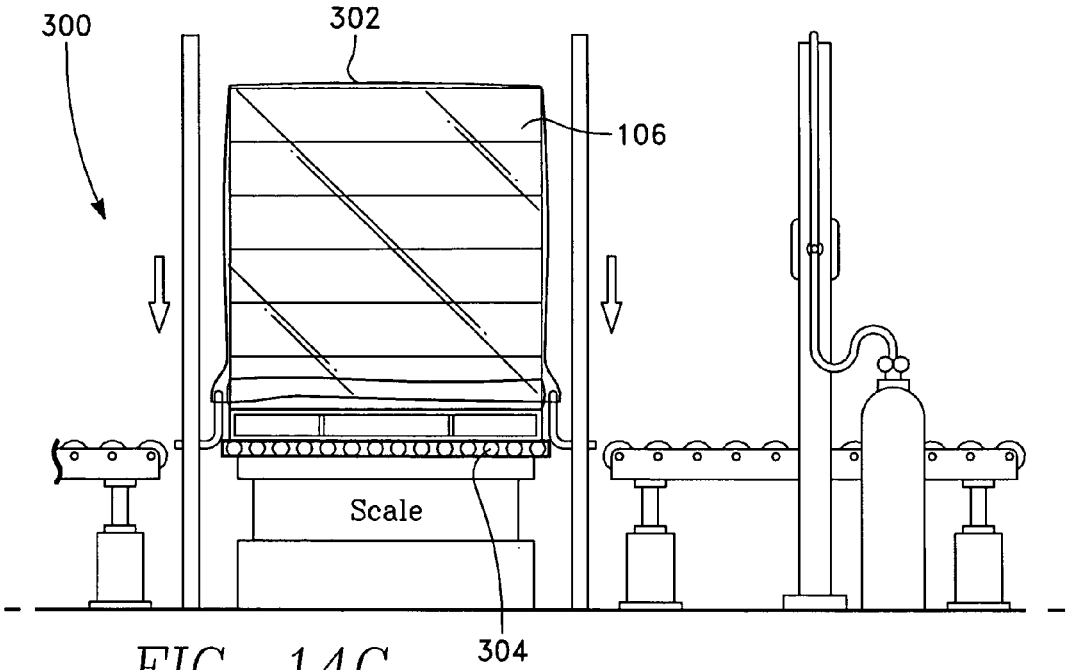
Figure 14D:
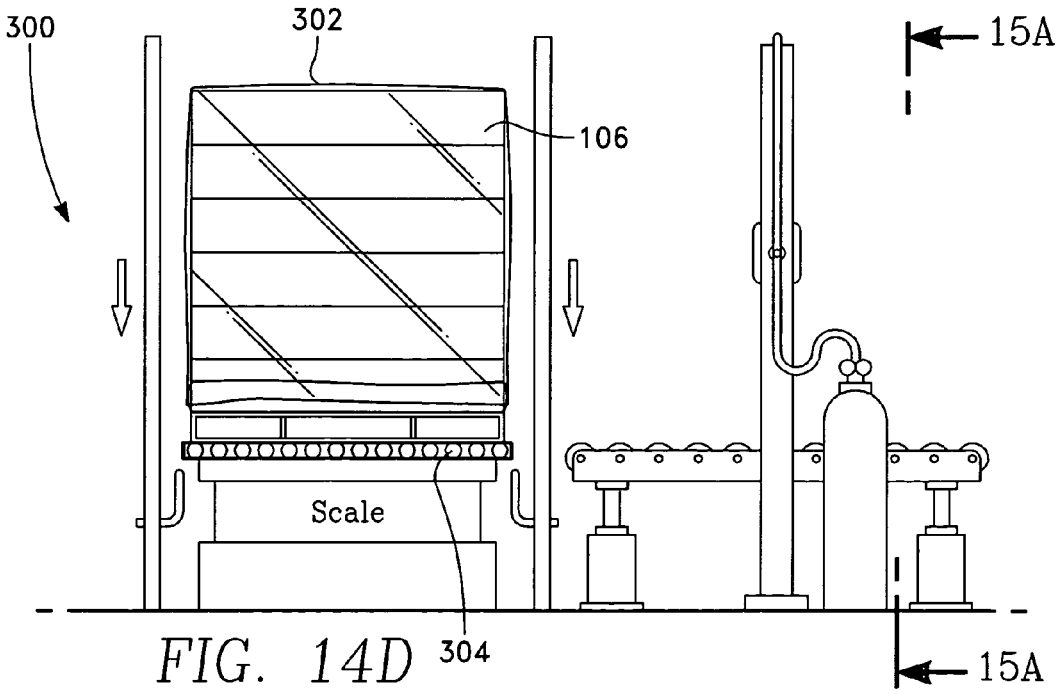
Figure 14E:
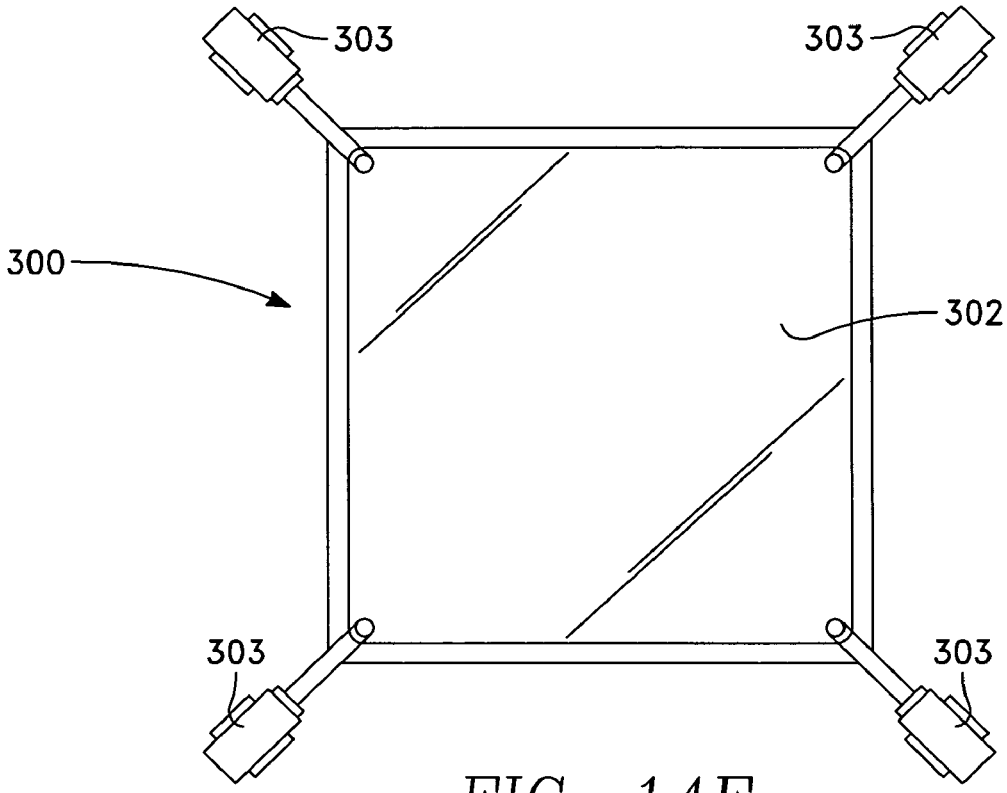
Figure 14F:
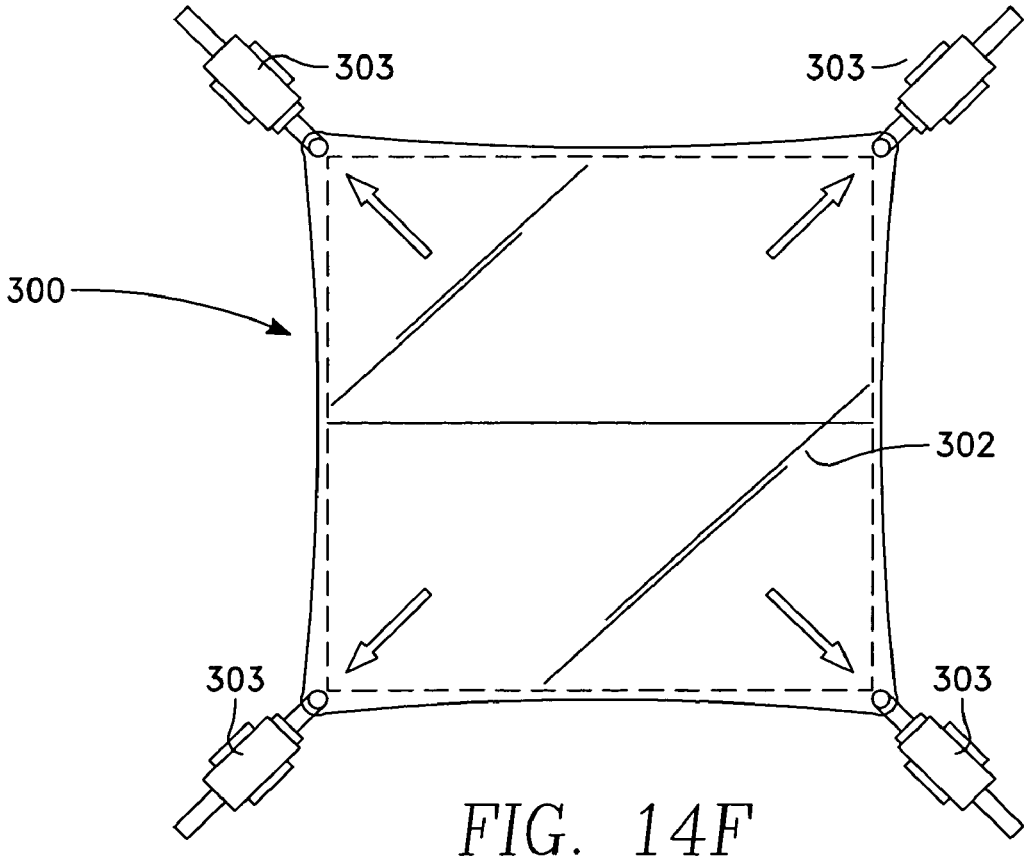
Figure 15:
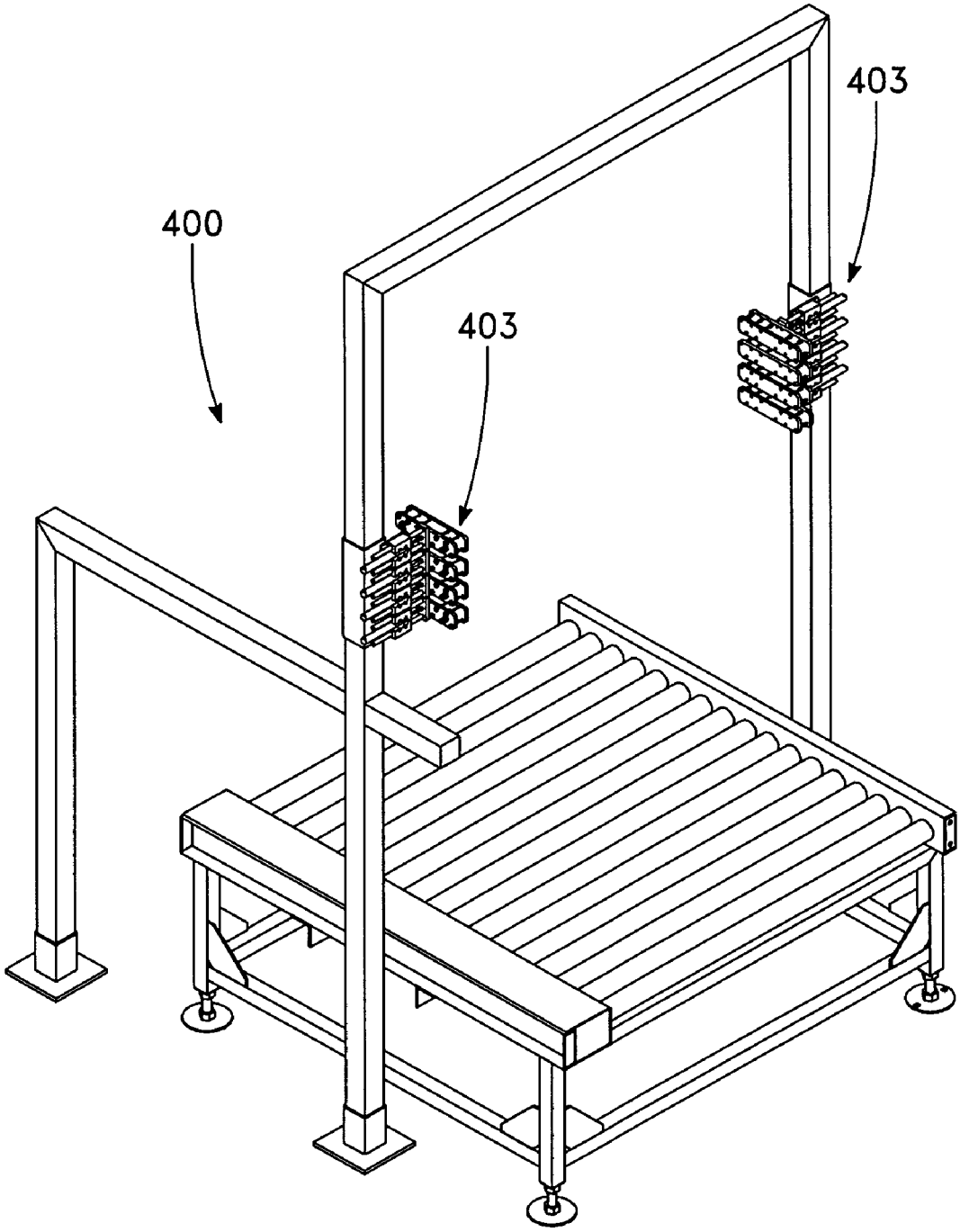
FIG. 15 shows a perspective view of the station 400, including bag/enclosure piercing devices 403, as shown in FIG. 12A.
Figure 15A:
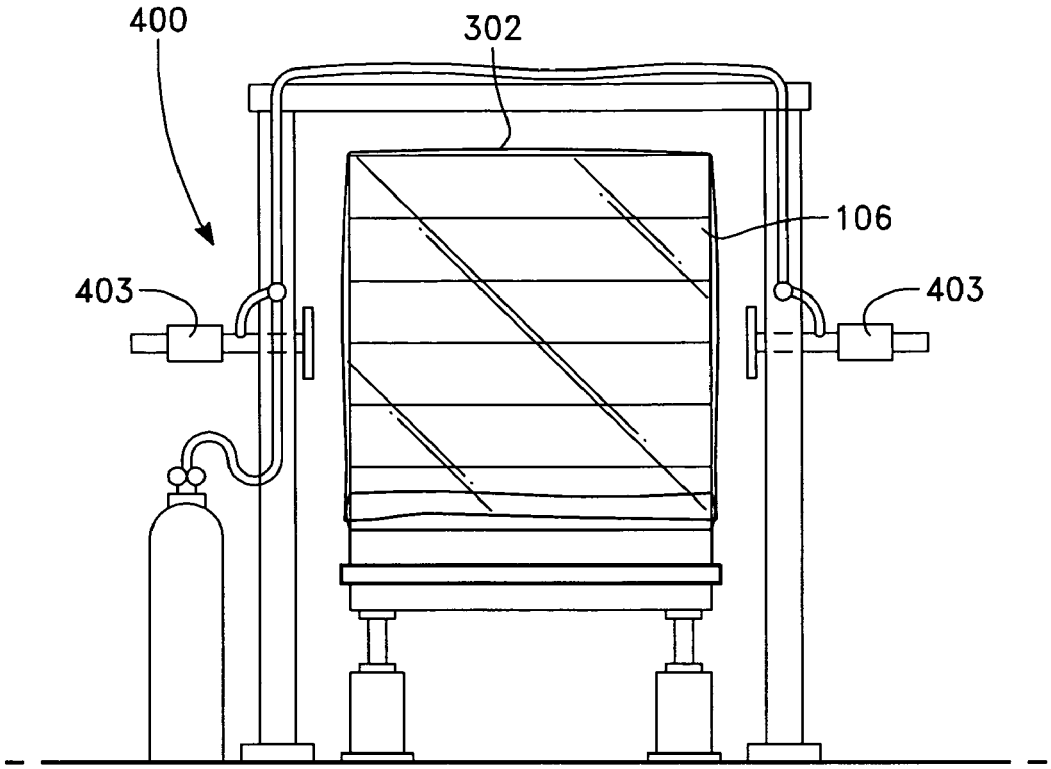
FIGS. 15A-D show several views of the structure and operation of the automatic modified atmosphere determination and formation station 400 for the enclosed/bagged palletized perishables shown in FIG. 11A.
Figure 15B:
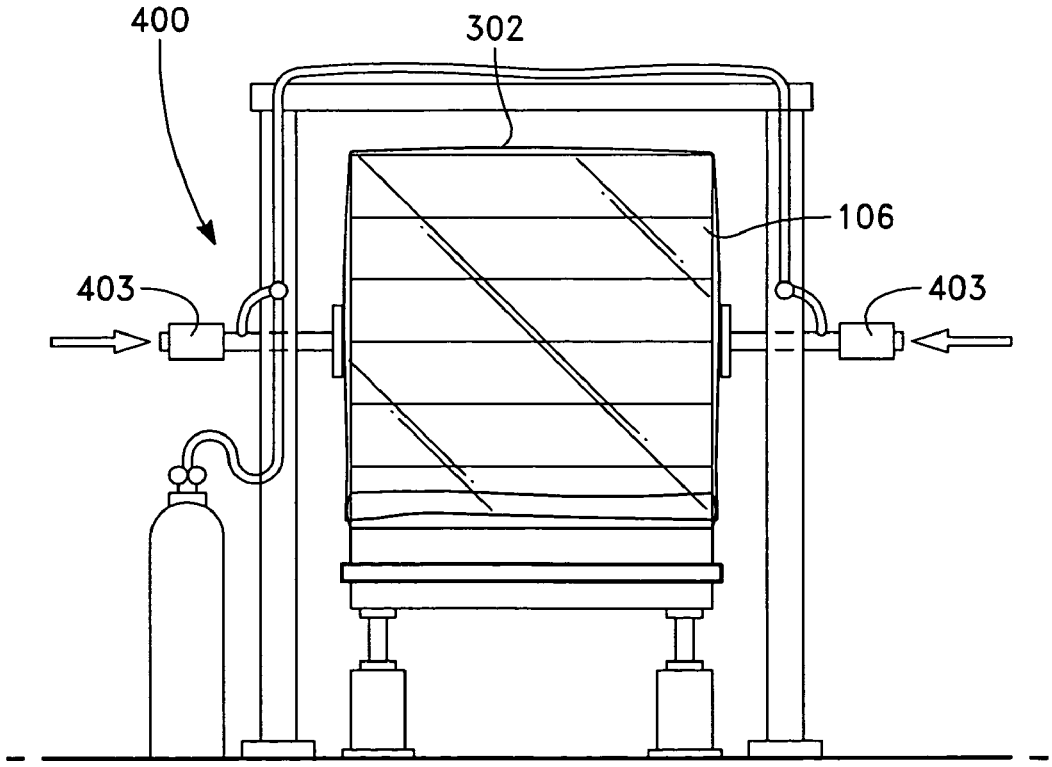
Figure 15C:
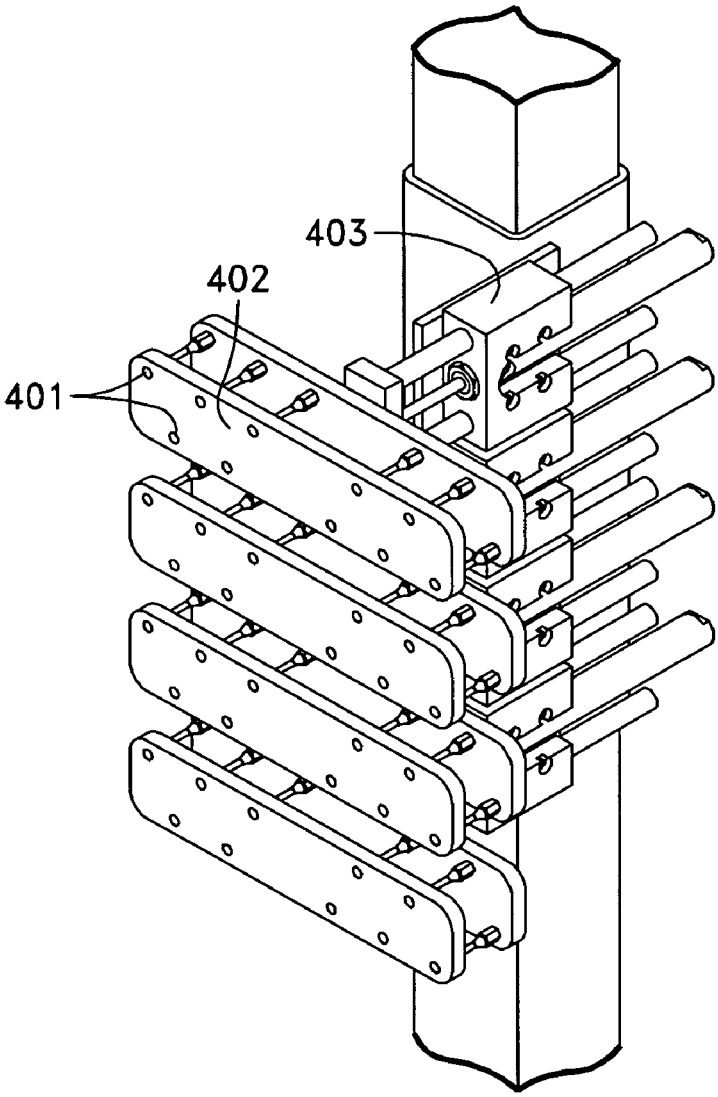
Figure 15D:
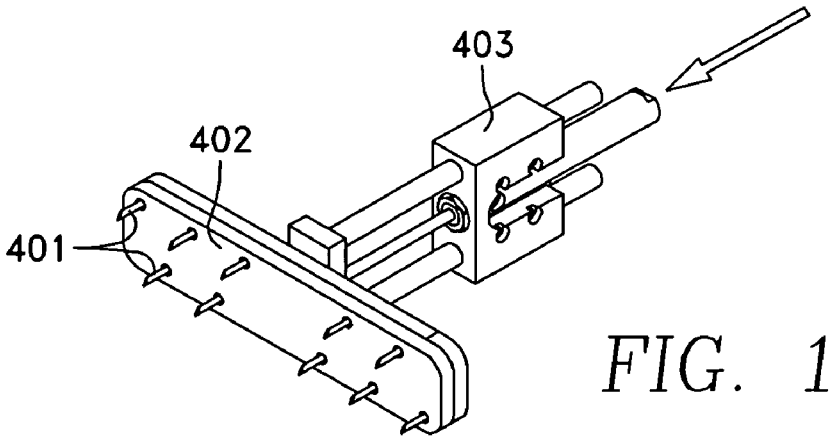

See FIG. 10D, step 631, and FIG. 11A. The system conveys the taped, bagged/enclosed, gasified, palletized perishables to an off load station 700 for removal and delivery of the palletized unit, via fork lift 701, to another, desired location.

See FIG. 8 for a suitable taping device. This device may include a knife or other cutting tool for automatically cutting the tape from a source roll after the pallet taping step is complete.

What is claimed is:

1. A system for automatically sealing a plastic bag/enclosure over containers of perishables carried on a pallet having a plastic sheet beneath the containers with sheet margins extending upwardly alongside the containers on the pallet, comprising:

a folding system for automatically folding and sealing said margins upwardly against the sides of said containers;

a system for automatically stretching a plastic bag/enclosure over said loaded pallet with the bag/enclosure opening overlapping and sealing against the upwardly extending margins of said plastic sheet; and a gas delivery system for automatically piercing said bag/enclosure and for delivering a gaseous modified atmosphere inside said bag/enclosure.

2. The system of claim 1, wherein said gas delivery system includes one or more needles/nozzles linked to said bagging system.

3. The system of claim 1, wherein said sealing against the upwardly extending margins of said plastic sheet is effected using a sealer that comprises a heat sealer, a tape sealer, a wrapping system, or a gluing system.

4. The system of claim 3 wherein said sealing against the upwardly extending margins of said plastic sheet is effected using a sealer that is a tape sealer that positions a tape roll in a plane parallel to the sides of the pallet and that delivers tape from a plane parallel to the sides of said pallet, and includes at least one tension control device, at least one tape guide, at least one roller, and a tape cutter.

5. The system of claim 1 further comprising an injector system for forming one or more calibrated holes in the side of the bag/enclosure after said bag/enclosure is sealed around said containers of perishables, to form and to maintain a desired modified atmosphere inside said bag/enclosure, wherein the number and size of holes is based, in part, on the weight and nature of said perishables.

6. A system for automatically sealing a plastic bag/enclosure over containers of perishables carried on a pallet having a plastic sheet beneath the containers with sheet margins extending upwardly alongside the containers on the pallet, comprising:

a folding system for automatically folding and sealing said margins upwardly against the sides of said containers;

a system for automatically stretching a plastic bag/enclosure over said loaded pallet with the bag/enclosure opening overlapping and sealing against the upwardly extending margins of said plastic sheet; and a gas delivery system for delivering a gaseous modified atmosphere inside said bag/enclosure, said gas delivery system including an injector system that comprises a plurality of needles/nozzles for piercing said bag and for delivering said gases inside said bag/enclosure.

* * * * *